US009213289B2

(12) United States Patent
Tomiyasu et al.

(10) Patent No.: US 9,213,289 B2
(45) Date of Patent: Dec. 15, 2015

(54) IMAGE FORMATION APPARATUS, DISPLAY METHOD, AND COMPUTER READABLE RECORDING MEDIUM STORING DISPLAY PROGRAM

(75) Inventors: Kazuhiro Tomiyasu, Toyokawa (JP); Taketoshi Yamahata, Toyokawa (JP); Koichi Amiya, Anjo (JP); Tomoko Maruyama, Toyokawa (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 492 days.

(21) Appl. No.: 13/233,346

(22) Filed: Sep. 15, 2011

(65) Prior Publication Data

US 2012/0069373 A1 Mar. 22, 2012

(30) Foreign Application Priority Data

Sep. 17, 2010 (JP) ..... 2010-209155

(51) Int. Cl.
*G03G 15/00* (2006.01)

(52) U.S. Cl.
CPC ..... *G03G 15/502* (2013.01)

(58) Field of Classification Search
CPC ..... G06K 15/1801; G03G 15/502
See application file for complete search history.

(56) References Cited

U.S. PATENT DOCUMENTS 7,782,497 B2 * 8/2010 Kimoto et al. ..... 358/448
8,780,366 B2 * 7/2014 Kim et al. ..... 358/1.13
2002/0018227 A1 * 2/2002 Asahi ..... 358/1.13
2005/0260009 A1 * 11/2005 Namizuka et al. ..... 399/80
2007/0008573 A1 * 1/2007 Yamada ..... 358/1.15
2008/0016450 A1 * 1/2008 Aono ..... 715/747
2008/0239357 A1 * 10/2008 Matsushima ..... 358/1.13
2008/0316526 A1 * 12/2008 Matsuzaki et al. ..... 358/1.15
2009/0097060 A1 * 4/2009 Okada ..... 358/1.15
2009/0225343 A1 * 9/2009 Tominaga ..... 358/1.9
2009/0235173 A1 * 9/2009 Ichihara ..... 715/733

(Continued)

FOREIGN PATENT DOCUMENTS

JP 2005-074716 A 3/2005
JP 2008-217826 A 9/2008

(Continued)

OTHER PUBLICATIONS

Office Action (Notice of Grounds of Rejection) dated Aug. 7, 2012, issued in corresponding Japanese Patent Application No. 2010-209155, and an English Translation thereof. (5 pages).

*Primary Examiner* — Hilina K Demeter
(74) *Attorney, Agent, or Firm* — Buchanan Ingersoll & Rooney PC

(57) ABSTRACT

An image formation apparatus is configured to display a category object indicating each of a plurality of categories in a selectable manner, accept selection of a first category among the plurality of categories, display a function object indicating each of functions corresponding to the selected first category among the plurality of functions in a selectable manner, accepting a setting related to a first function among functions corresponding to the first category, determining whether the setting of a second function corresponding to a second category other than the first category has changed or not in response to a setting entered related to the first function, and when a setting of the second function corresponding to the second category has changed, displaying information indicating that the setting of the second function has changed.

24 Claims, 20 Drawing Sheets

(56) References Cited

U.S. PATENT DOCUMENTS

2009/0237692 A1* 9/2009 Endoh et al. ..... 358/1.9
2009/0237699 A1* 9/2009 Umezawa ..... 358/1.13
2010/0033744 A1* 2/2010 Maeda ..... 358/1.9
2010/0149592 A1* 6/2010 Yoshida ..... 358/1.15
2010/0231946 A1* 9/2010 Shozaki et al. ..... 358/1.13

FOREIGN PATENT DOCUMENTS

JP 2009-225250 A 10/2009
JP 2009-225261 A 10/2009

* cited by examiner

IMAGE FORMATION APPARATUS, DISPLAY METHOD, AND COMPUTER READABLE RECORDING MEDIUM STORING DISPLAY PROGRAM

This application is based on Japanese Patent Application No. 2010-209155 filed with the Japan Patent Office on Sep. 17, 2010, the entire content of which is hereby incorporated by reference.

BACKGROUND OF THE INVENTION

1. Field of the Invention

The present invention relates to an input interface technique for accepting a setting related to various functions of an image formation apparatus.

2. Description of the Related Art

An image formation apparatus accepts an instruction from a user through a touch panel. In other words, the user enters a setting related to various functions such as image printing, scanning, and the like into an image formation apparatus. For example, the user sets the magnification ratio for the image formation apparatus having a magnification copy function and/or sets the darkness level of a color for the image formation apparatus having the function of modifying the picture quality/density.

For example, Japanese Laid-Open Patent Publication No. 2005-074716 discloses an image formation apparatus allowing the state of a function setting, after the function has been set, to be maintained even when the mode is switched from the normal display mode to the simple display mode, or from the simple display mode to the normal display mode.

When the user enters a setting related to a first function belonging to a first category through the operation panel, there may be the case where a previous setting of another function (second function) will modified or canceled automatically in conjunction with the relevant setting. However, the user may possibly not realize that the previous setting related to the second function has been modified or canceled. Particularly, this possibility will become higher in the case where the second function does not belong to the first category. This is because the user may generally pay attention to only the first category. Thus, there is the possibility that a job will be executed in accordance with a setting not intended by the user.

SUMMARY OF THE INVENTION

The present invention is directed to solving such a problem. An object of the present invention is to notify the user, when a setting related to a first function belonging to a first category is entered, that a previous setting related to a second function belonging to a second category has been changed in conjunction with the relevant setting.

An aspect of the present invention is directed to an image formation apparatus including a plurality of functions, each which is associated with any of a plurality of categories. The image formation apparatus includes a display, a first acceptance unit causing the display to display category objects indicating the plurality of categories, respectively, in a selectable manner for accepting selection of a first category among the plurality of categories, a second acceptance unit causing the display to display function objects indicating functions, respectively, corresponding to the selected first category among the plurality of functions in a selectable manner for accepting a setting related to a first function among the functions corresponding to the first category, a determination unit determining whether a setting of a second function corresponding to a second category other than the first category has changed or not in response to a setting entered related to the first function, and a display modification unit causing the display, when the setting of the second function corresponding to the second category has changed, to display information indicating that the setting of the second function has changed.

Preferably, the display modification unit modifies, when the setting of the second function has changed, the display manner of the category object of the second category.

Preferably, the display modification unit causes the display, when the setting of the second function has changed, to display the first function objects indicating functions, respectively, corresponding to the first category, and a second function object indicating the second function whose setting has been changed.

Preferably, the display manner of the second function object differs from the display manner of the first function objects.

Preferably, the display modification unit causes the display to display, when the setting of the second function has changed, first function objects indicating functions, respectively, corresponding to the first category, a second function object indicating the second function belonging to the second category and whose setting has been changed, and a third function object indicating a function other than the second whose setting has been changed in the second category. The display manner of the second function object differs from the display manner of the third function object.

Preferably, each of the first function objects includes a software button of a first size. Each of the second and third function objects includes a software button of a second size smaller than the first size.

Preferably, each of the first function objects includes a software button of a first size. Each of the second and third function objects includes a mark smaller than the first size. The mark corresponding to the first second and third function objects constitute a function bar.

Preferably, the display modification unit causes the display to display, when the setting of the second function has changed, a list of the labels of functions corresponding to the second category as the second function object.

Preferably, the display modification unit terminates display of the second function object when any of software buttons appearing on the display is depressed.

Preferably, the image formation apparatus further includes a hardware button. The display modification unit terminates display of the second function object when the hardware button is depressed.

Preferably, the display modification unit terminates display of the second function object when a category other than the second category is selected.

Preferably, the image formation apparatus further includes a timer for counting time during which the second function object is displayed. The display modification unit terminates the display of the second function object when the time during which the second function object is displayed reaches a predetermined value.

Preferably, the condition to terminate the display of the second function object differs depending upon the type of the second category.

Another aspect of the present invention is directed to a method of display at an image formation apparatus including a plurality of functions, each which is associated with any of a plurality of categories. The image formation apparatus includes a display. The display method includes the steps of:

causing the display to display a category objects indicating a plurality of categories, respectively, in a selectable manner; accepting selection of a first category among the plurality of categories; causing the display to display function objects indicating functions, respectively, corresponding to the selected first category among the plurality of functions in a selectable manner; accepting a setting related to a first function among the functions corresponding to the first category; determining whether a setting of the second function corresponding to a second category other than the first category has changed or not in response to a setting entered related to the first function; and causing the display to display, when the setting of the second function corresponding to the second category has changed, information indicating that the setting of the second function has changed.

A further aspect of the present invention is directed to a computer readable storage medium storing a display program for an image formation apparatus including a plurality of functions, each which is associated with any of a plurality of categories. The image formation apparatus includes a display and a processor. The display program causes the processor to execute the steps of: causing the display to display category objects indicating a plurality of categories, respectively, in a selectable manner; accepting selection of a first category among the plurality of categories; causing the display to display function objects indicating functions, respectively, corresponding to the selected first category among the plurality of functions in a selectable manner; accepting a setting related to a first function among the functions corresponding to the first category; determining whether a setting of the second function corresponding to a second category other than the first category has changed or not in response to a setting entered related to the first function; and causing the display to display, when the setting of the second function corresponding to the second category has changed, information indicating that the setting of the second function has changed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
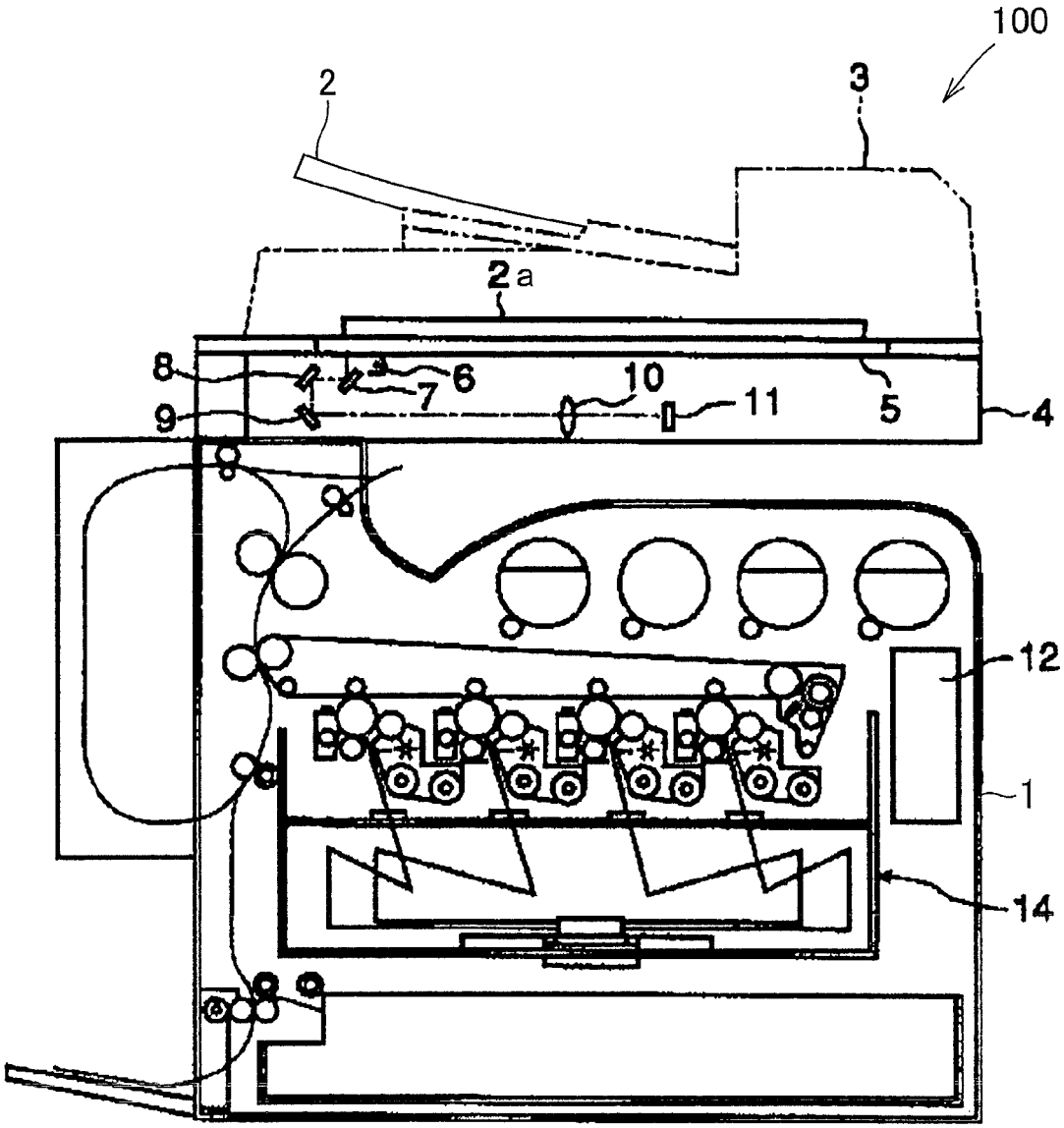
FIG. 1 is a front cross-sectional view representing an overall configuration of an image formation apparatus 100 according to an embodiment.

Embodiments of the present invention will be described hereinafter with reference to the drawings. In the following description, the same components have the same reference character allotted. Their designation and function are also identical. Therefore, detailed description thereof will not be repeated. In the following, the "first category" corresponds to "Basic Function 2", whereas the "second category" corresponds to "Basic Function 1" and "Extended Function".

First Embodiment

Overall Configuration of Image Formation Apparatus 100

First, one manner of an overall configuration of an image fotmation apparatus 100 according to the first embodiment will be described with reference to FIGS. 1 and 2.

In the present embodiment, a tandem-type digital color multi function peripheral will be described by way of example of image formation apparatus 100. It is noted that the digital color multi function peripheral can generally execute a scan job for scanning an image of a set document and storing the image in an HDD (Hard Disk Drive) or the like, a copy job for further printing the image on a sheet of paper or the like, a print job for printing on a sheet of paper based on a print instruction from an external terminal such as a personal computer (hereinafter also denoted as a PC), a facsimile job for receiving facsimile data from a facsimile machine or the like and storing the data in the HDD or the like, an HDD print job (a BOX print job) for printing an image stored in the HDD or the like on a sheet of paper or the like, and so forth.

Figure 2:
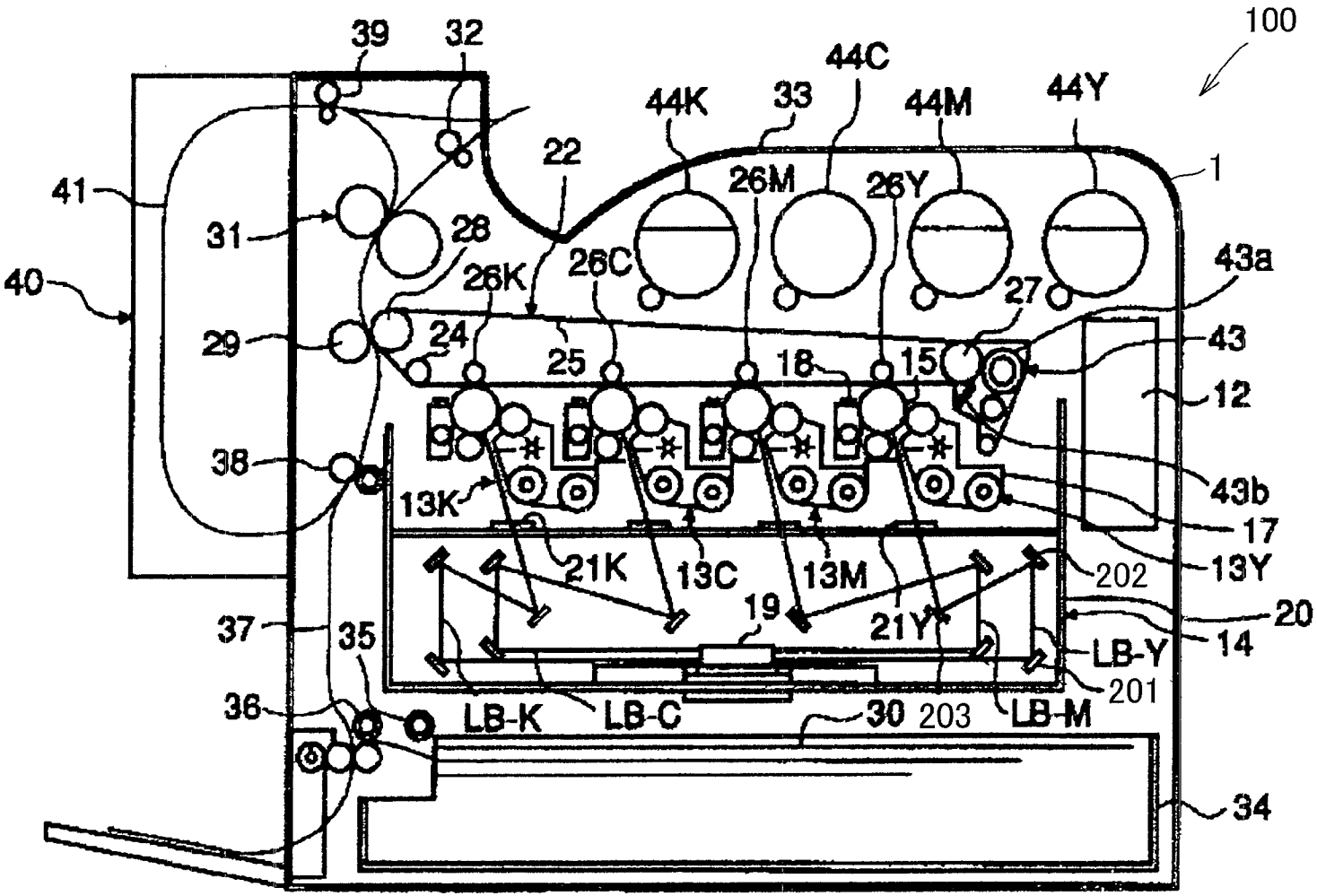
FIG. 2 is a front cross-sectional view representing a configuration of a print engine portion of image formation apparatus 100 of the present embodiment.

Referring to FIGS. 1 and 2, in an upper portion of a main body 1, an automatic document feeder (ADF) 3 for automatically transporting a document 2 one by one separately and an image scanner 4 for scanning an image on document 2 transported by automatic document feeder 3 are arranged. Image scanner 4 irradiates document 2 placed on a platen glass 5 with a light source 6. Image scanner 4 scans for exposure, a reflected light image from document 2 on an image scanning element 11 implemented by a CCD (Charge Coupled Device) or the like through a reduction optical system constituted of a full rate mirror 7, half rate mirrors 8, 9 and an imaging lens 10. Image scanner 4 uses image scanning element 11 to scan a color material reflected light image of document 2 at prescribed dot density (for example, 16 dots/mm).

Image scanner 4 has document scanning functions such as scanning a FAX transmission document, Scan to E-Mail, Box saving, and the like. A color material reflected light image of document 2 scanned by image scanner 4 is sent to an image processing unit 12, for example, as document reflectance data of three colors of red (R), green (G), blue (B) (each having 8 bits).

Image processing unit 12 subjects the reflectance data of document 2 to prescribed image processing such as shading correction, position displacement correction, lightness/color space conversion, gamma correction, erasing of a frame, edition of color/movement, and the like. In addition, image processing unit 12 can also subject image data sent from a personal computer or the like to prescribed image processing. The image data subjected to prescribed image processing by image processing unit 12 is again converted by image processing unit 12 to document reproduction color material gradation data of four colors of yellow (Y), magenta (M), cyan (C), black (K) (each having 8 bits). The image data is sent to a print head 14, which carries out image exposure onto image forming units 13Y, 13M, 13C, 13K of respective colors of yellow (Y), magenta (M), cyan (C), black (K). Print head 14 serving as an image exposure apparatus carries out image exposure using a laser beam LB, in accordance with the document reproduction color material gradation data of a prescribed color.

In a case of a tandem-type digital color multi function peripheral, in main body 1, as shown in FIGS. 1 and 2, four image forming units 13Y, 13M, 13C, 13K of yellow (Y), magenta (M), cyan (C), black (K) are arranged in parallel at regular intervals in the horizontal direction. These four image forming units 13Y, 13M, 13C, 13K are all configured similarly to one another.

Referring to FIG. 2, each of four image forming units 13Y, 13M, 13C, 13K is constituted of a photoconductor drum 15 serving as an image carrier rotationally driven at a prescribed speed, a charging roller for primary charging for uniformly charging a surface of this photoconductor drum 15, print head 14 serving as an image exposure apparatus for forming by exposure, an image corresponding to a prescribed color on a surface of photoconductor drum 15 to thereby form an electrostatic latent image, a developer 17 for developing the electrostatic latent image formed on photoconductor drum 15 with toner of a prescribed color, and a cleaning apparatus 18 for cleaning the surface of photoconductor drum 15.

As shown in FIGS. 1 and 2, print head 14 is configured in common to four image forming units 13Y, 13M, 13C, 13K. Print head 14 modulates four semiconductor lasers that are not shown in accordance with the document reproduction color material gradation data of respective colors and emits laser beams LB-Y, LB-M, LB-C, LB-K from the respective semiconductor lasers in accordance with the gradation data. It is noted that print head 14 above may individually be configured for each of the plurality of image forming units.

One rotating polygon mirror 19 is irradiated with laser beams LB-Y, LB-M, LB-C, LB-K emitted from the four respective semiconductor lasers, causing deflection and scanning. Here, among laser beams LB-Y, LB-M, LB-C, LB-K emitted from the four respective semiconductor lasers above, laser beam LB-Y and laser beam LB-M are emitted toward one side surface of rotating polygon mirror 19 and other laser beams LB-C and laser beam LB-K are emitted toward the other side surface of rotating polygon mirror 19.

Consequently, laser beams LB-Y, LB-M and laser beams LB-C, LB-K are opposite to each other in the direction of deflection and scanning by rotating polygon mirror 19. Laser beams LB-Y, LB-M, LB-C, LB-K deflected and scanned by rotating polygon mirror 19 are reflected by a plurality of reflection mirrors 201 to 203 through an f-θ lens not shown. Laser beams LB-Y, LB-M, LB-C, LB-K are scanned for exposure onto photoconductor drums 15 in respective image forming units through a window 21 from diagonally below.

Image processing unit 12 successively outputs image data of respective colors to print head 14 provided in common to image forming units 13Y, 13M, 13C, 13K of respective colors of yellow (Y), magenta (M), cyan (C), black (K), and laser beams LB-Y, LB-M, LB-C, LB-K emitted from this print head 14 in accordance with the image data are scanned for exposure onto the respective surfaces of corresponding photoconductor drums 15. An electrostatic latent image is thus formed.

Then, the electrostatic latent image formed on photoconductor drum 15 is developed by developer 17 as a toner image of each color of yellow (Y), magenta (M), cyan (C), black (K), as shown in FIGS. 1 and 2. The toner images of respective colors of yellow (Y), magenta (M), cyan (C), black (K) are multiply transferred by primary transfer rollers 26 onto an intermediate transfer belt 25 of an intermediate transfer belt unit 22 arranged above each image forming unit 13Y, 13M, 13C, 13K.

Intermediate transfer belt 25 is wound around a drive roller 27, a back-up roller 28 and a tension roller 24 at constant tension. Intermediate transfer belt 25 is circulated and driven in a prescribed direction at a prescribed speed by drive roller 27 rotationally driven by a dedicated drive motor (not shown) having excellent constant speed property. For example, a belt made by forming a film of a synthetic resin such as flexible polyimide like a band and connecting opposite ends of the synthetic resin film formed like a band through means such as welding to thereby obtain an endless belt is employed as intermediate transfer belt 25.

The toner image of respective colors of yellow (Y), magenta (M), cyan (C), black (K) multiply transferred onto intermediate transfer belt 25 above is transferred onto a sheet of transfer paper 30 serving as a transfer material, by a secondary transfer roller 29 pressed against back-up roller 28 with the intermediate transfer belt being interposed, by means of pressing force and electrostatic force. Transfer paper 30 onto which the toner images of respective colors has been transferred is transported to a fixer 31 located above.

Secondary transfer roller 29 is located on the side of back-up roller 28. Secondary transfer roller 29 secondarily collectively transfers the toner images of respective colors onto transfer paper 30 transported from below to above. Then, transfer paper 30 onto which the toner images of respective colors have been transferred is subjected to a fixation process with heat and pressure by fixer 31 and thereafter ejected onto an ejection tray 33 provided in the upper portion of main body 1 by an ejection roller 32.

In the present embodiment, transfer paper 30 having a prescribed size is transported from a paper feed cassette 34 through a paper transport path 37 to a register roller 38 by a paper feed roller 35 and a roller pair 36 for separated paper transport, and stopped there. Transfer paper 30 is sent to a secondary transfer position of intermediate transfer belt 25 by register roller 38 that rotates at prescribed timing.

It is noted that, in a case of image formation on opposite surfaces of transfer paper 30 in the digital color multi function peripheral, transfer paper 30 on which one surface an image has been fixed is not directly ejected to ejection tray 33 by ejection roller 32. The digital color multi function peripheral switches the direction of transport of transfer paper 30 by using a switching gate not shown and transports transfer paper 30 to a both-surface transport unit 40 through a roller pair 39 for paper transport.

Both-surface transport unit 40 transports transfer paper 30 again to register roller 38 by using a transport roller pair (not shown) provided along a transport path 41, with transfer paper 30 being turned upside down. Then, after the image is transferred and fixed onto the back surface of transfer paper 30, transfer paper 30 is ejected onto ejection tray 33. In FIGS. 1 and 2, 44Y, 44M, 44C, 44K represent toner cartridges for supplying toner of prescribed colors to developers 17 of respective colors of yellow (Y), magenta (M), cyan (C), black (K).

Hardware Configuration of Image formation apparatus 100

A hardware configuration of image formation apparatus 100 will now be described.

Figure 3:
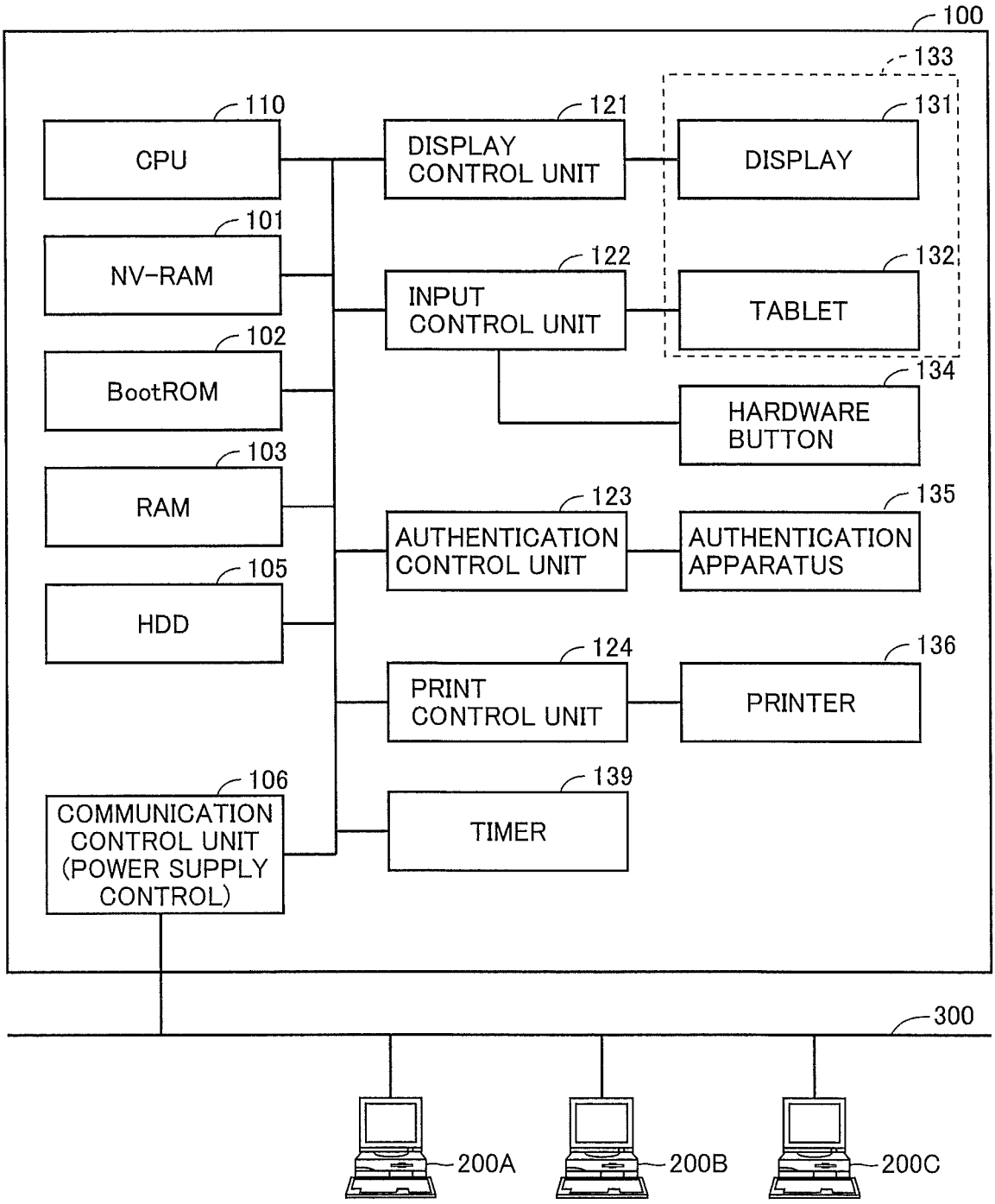
FIG. 3 is a block diagram representing a hardware configuration of image formation apparatus 100 of the present embodiment.

Referring to FIG. 3, image formation apparatus 100 includes a display 131, a tablet 132, a hardware button 134, an authentication apparatus 135, a printer 136, and a timer 139.

For display 131, a liquid crystal display (LCD) or a CRT (cathode-ray tube) display, for example, is employed. In the present embodiment, a tablet 132 is provided at the surface of display 131. Namely, display 131 and tablet 132 constitute a touch panel 133.

Image formation apparatus 100 includes, as hardware button 134, a power-on key, ten key, arrow key, determination key, and the like.

Authentication apparatus 135 includes a contact/non-contact type IC card authentication apparatus, a finger vein authentication apparatus, or the like. Printer 136 in FIG. 3 refers to the printer engine described with reference to FIGS. 1 and 2. Timer 139 counts the displayed time of an object belonging to a category other than the currently selected category, as will be described afterwards.

Image formation apparatus 100 includes a central processing unit (CPU) 110. CPU 110 is connected to an NV-RAM (Non Volatile-Random Access Memory) 101, a BootROM (Read Only Memory) 102, a RAM 103, a hard disk drive (HDD) 105, a communication control unit (communication interface) 106, a display control unit 121, an input control unit 122, an authentication control unit 123, and a print control unit 124.

CPU 110 controls the overall operation of image formation apparatus 100 based on data stored in NV-RAM 101, BootROM 102, RAM 103, and hard disk drive 105. RAM 103 (volatile memory) provides a work area for an operation of CPU 110. HDD 105 (non-volatile memory) stores image data subjected to image formation during execution of a copy job or print job by image formation apparatus 100. Further, HDD 105 stores (saves in BOX) image data that was scanned in a scan job to allow output subsequently.

CPU 110 provides the display of a plurality of software buttons, each indicating a corresponding one of a plurality of functions, on touch panel 133 (display 131) according to a program transferred to RAM 103. In image formation apparatus 100 of the present embodiment, RAM 103 stores a table that will be described afterwards, indicating the corresponding relationship between a plurality of categories and a plurality of functions.

Schematic Operation Related to User Interface

A schematic operation related to a user interface according to the present embodiment will be described hereinafter. In the present embodiment, CPU 110 implements a user interface set forth below through usage of touch panel 133.

Figure 4:
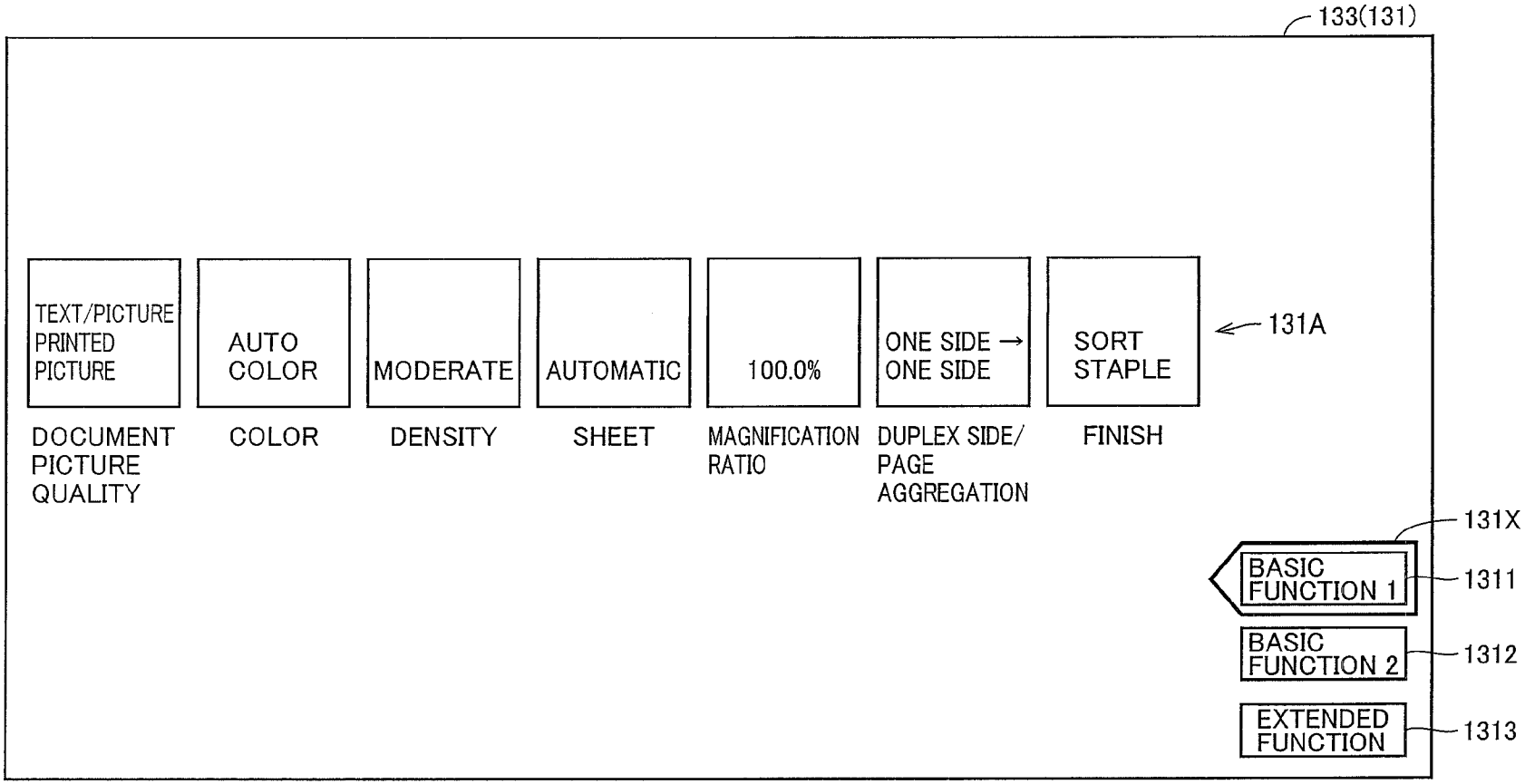
FIG. 4 is a pictorial representation of a touch panel 133 when a second category (Basic Function 1) is selected.

FIG. 4 is a pictorial representation of a touch panel 133 when a second category (Basic Function 1) is selected. Referring to FIG. 4, when the category of "Basic Function 1" is selected, CPU 110 causes touch panel 133 to display a button 1311 indicating the category of "Basic Function 1" in a selected state. Further, CPU 110 causes touch panel 133 to display a button 1312 indicating the category of "Basic Function 2" and a button 1313 indicating the category of "Extended Function" in a de-selected state. On touch panel 133, button 1311 indicating the selected category is surrounded by a frame graphic 131X.

CPU 110 causes touch panel 133 to display a plurality of software buttons 131A to indicate each of a plurality of functions corresponding to the category of "Basic Function 1" in a selectable manner. CPU 110 responds to a depression of any of software buttons 131A by the user to perform the setting related to the selected function.

Figure 5:
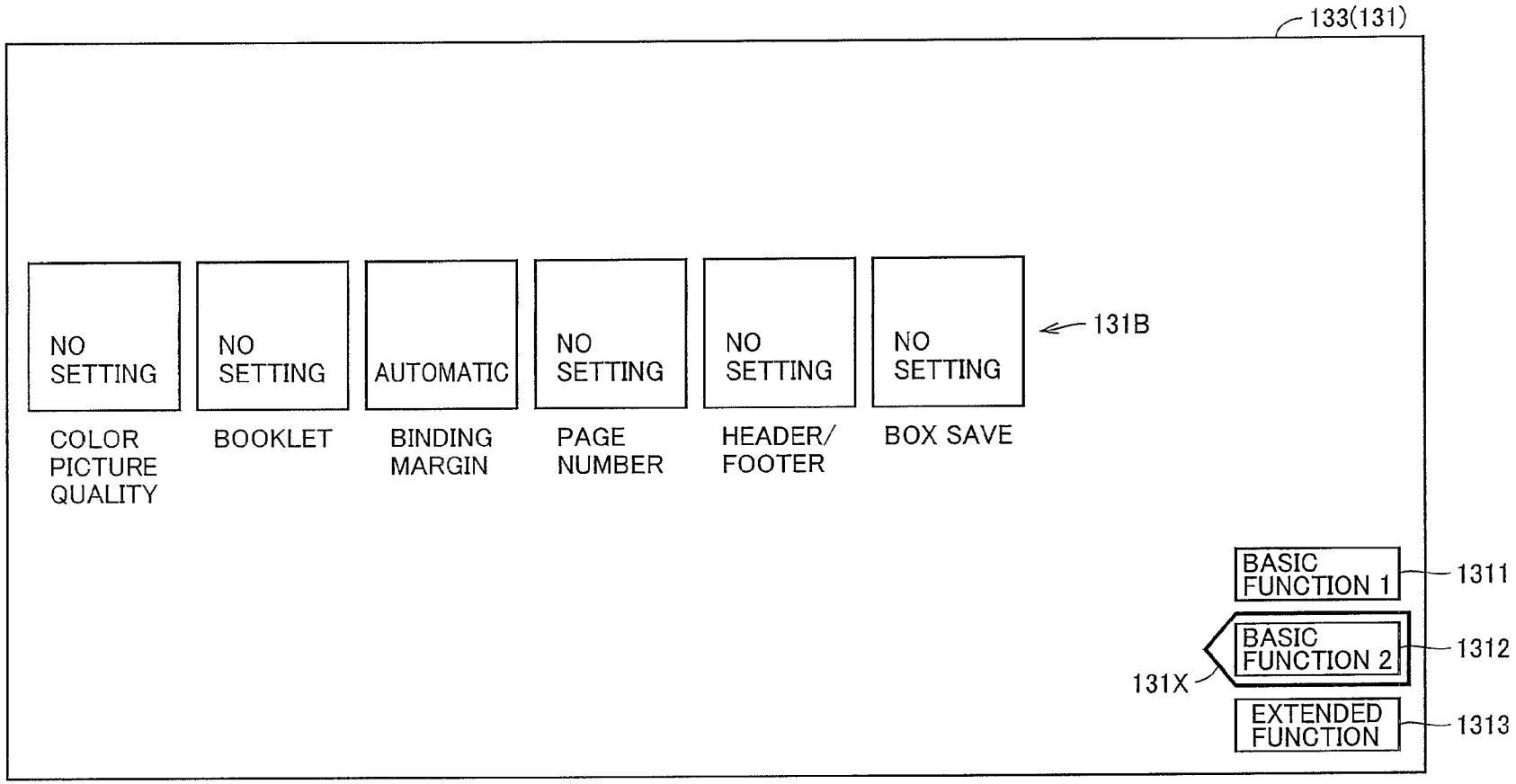
FIG. 5 is a pictorial representation of touch panel 133 when a first category (Basic Function 2) is selected.

FIG. 5 is a pictorial representation of touch panel 133 when the first category ("Basic Function 2") is selected. Referring to FIG. 5, when the category of "Basic Function 2" is selected, CPU 110 causes touch panel 133 to display button 1312 indicating the category of "Basic Function 2" in a selected state. CPU 110 causes touch panel 133 to display button 1311 indicating the category of "Basic Function 1" and button 1313 indicating the category of "Extended Function" in a de-selected state.

CPU 110 causes touch panel 133 to display a plurality of software buttons 131B to indicate each of a plurality of functions corresponding to the category of "Basic Function 2" in a selectable manner. CPU 110 responds to a depression of software button 131B by the user to perform the setting related to the selected function.

In the present embodiment, RAM 103 stores a function relation table that represents the relationship between a plurality of functions. In the function relation table, a plurality of functions and information to identify, when a setting related to a certain function is input, another function to be modified in response to the relevant input, or information to identify the setting contents of that another function are stored, in correspondence.

For example, when the setting of any of the functions corresponding to the category of "Basic Function 2" is modified, CPU 110 may refer to the function relation table to automatically modify the setting of a function corresponding to the category of "Basic Function 1", or a function corresponding to the category of "Extended Function". An event of the "booklet" function belonging to category "Basic Function 2" being set to "right-to-left folded" will be described hereinafter.

Figure 6:
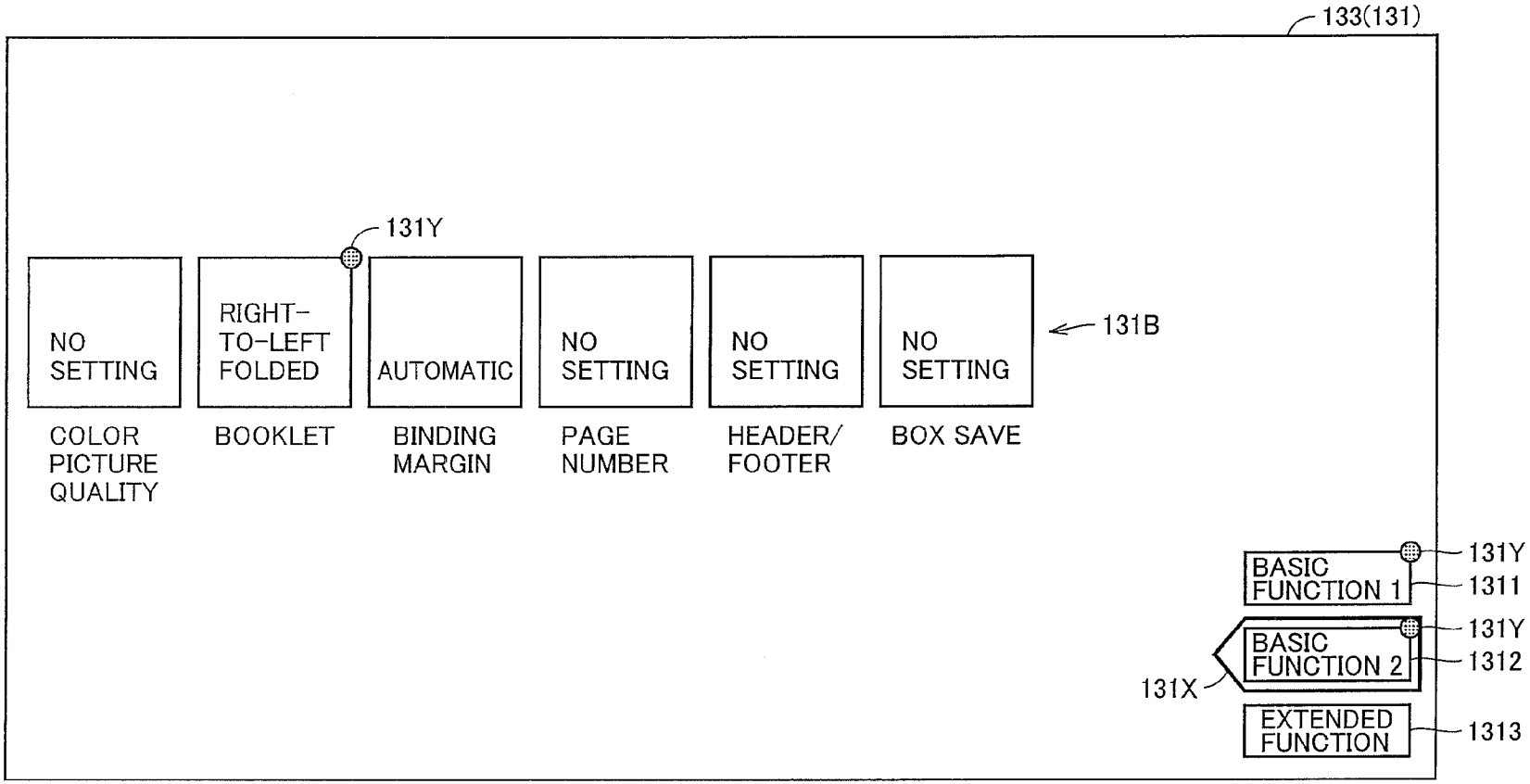
FIG. 6 is a pictorial representation of touch panel 133 when the "booklet" function belonging to a category "Basic Function 2" is set at "right-to-left folded" according to the first embodiment.

FIG. 6 is a pictorial representation of touch panel 133 when the "booklet" function belonging to the category of "Basic Function 2" is set at "right-to-left folded" according to the first embodiment. When the "booklet" function belonging to the "Basic Function 2" category is set at "right-to-left folded", CPU 110 refers to the function relation table to automatically set over again the function belonging to the "Basic Function 1" category.

More specifically, when the "booklet" function belonging to the "Basic Function 2" category is set at "right-to-left folded", CPU 110 sets the "magnification" function belonging to the "Basic Function 1" category to "70.7%", the "duplex side/page aggregation" function belonging to the "Basic Function 1" category to "one side→duplex side", and the "finishing" function belonging to the "Basic Function 1" category to "saddle stitch".

CPU 110 determines whether the setting of "Basic Function 1" or "Extended Function" has been automatically modified in response to the setting of the function of "Basic Function 2" being changed. When the setting of a function belonging to the "Basic Function 1" category, differing from "Basic Function 2", has been changed automatically, CPU 110 changes the display manner of button 1311 of the relevant "Basic Function 1" from the former display manner.

In the present embodiment, CPU 110 causes touch panel 133 to display a mark 131Y on button 1311 indicating "Basic Function 1". Alternatively, CPU 110 may be configured to cause touch panel 133 to alter the color or shape of button 1311 indicating "Basic Function 1". CPU 110 also causes touch panel 133 to display mark 131Y on button 1312 indicating "Basic Function 2" that is currently selected. Further, CPU 110 causes the display of mark 131Y on the "booklet" button 131B accepting change in the setting on touch panel 133.

In the present embodiment, CPU 110 modifies the display manner of the software button indicating the category to which the function having the setting modified by the user belongs to, and the display manner of the software button indicating the category to which the function whose setting has been changed automatically by the relevant modification belongs to, from each former display manner.

Thus, the present embodiment allows the user to be notified that the setting of a function not belonging to the currently selected category has been changed automatically. Particularly, the user can be notified of the category to which the function whose setting has been changed automatically belongs to in the present embodiment.

Control Method

A control process at image formation apparatus 100 according to the present embodiment will be described hereinafter with reference to the flowchart of FIG. 7. In the following, it is assumed that "Basic Function 2" is selected as the category. In other words, it is assumed that CPU 110 provides the display of software buttons 131B indicating the functions corresponding to "Basic Function 2" on touch panel 133 in a selectable manner.

Figure 7:
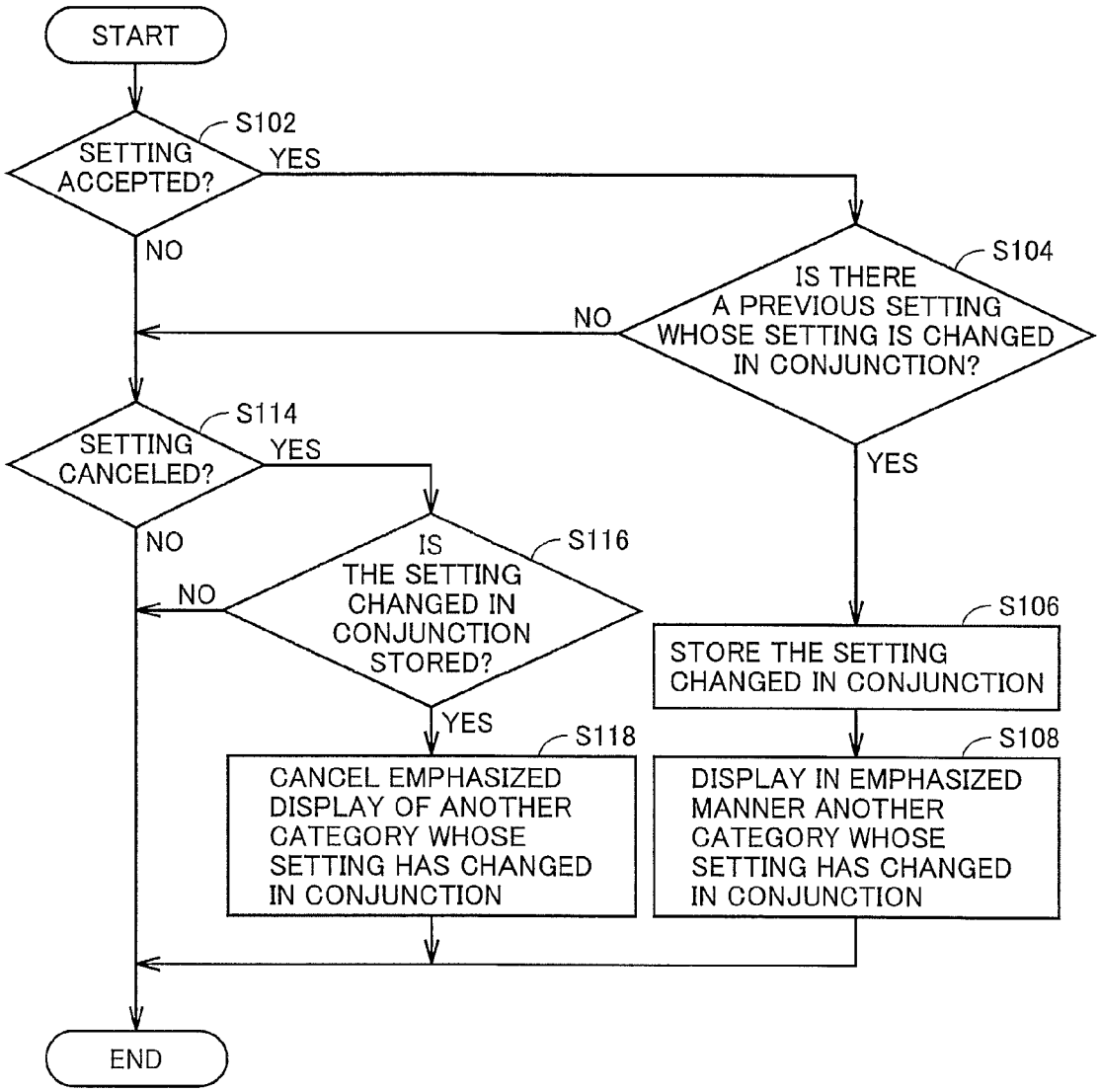
FIG. 7 is a flowchart of a control process at image formation apparatus 100 according to the first embodiment.

Referring to FIG. 7, CPU 110 determines whether a setting related to a function corresponding to "Basic Function 2" has been accepted from a user through touch panel 133 (step S102). When a setting related to the function corresponding to "Basic Function 2" is not accepted from the user (when NO at step S102), CPU 110 executes the process starting from step S114.

When a setting related to a function corresponding to "Basic Function 2" is accepted from the user (YES at step S102), CPU 110 refers to the function relation table to determine whether there is a function whose setting is automatically changed in conjunction with the relevant setting, among the functions corresponding to "Basic Function 1" or "Extended Function" (step S104). When there is no function whose setting is to be automatically changed in conjunction with the relevant setting among the functions corresponding to "Basic Function 1" or "Extended Function" (NO at step S104), CPU 110 executes the process starting from step S114.

When there is a function whose setting is to be changed automatically in conjunction with the relevant setting among the functions corresponding to "Basic Function 1" or "Extended Function" (YES at step S104), CPU 110 stores the setting changed automatically in conjunction with the relevant setting into RAM 103 (step S106).

Then, as shown in FIG. 6, CPU 110 causes touch panel 133 to display, in an emphasized manner, software button 1311 indicating the "Basic Function 1" category corresponding to the function whose setting was changed automatically in conjunction with the relevant setting (step S108). In other words, CPU 110 causes the display of a mark on software button 1311 indicating the "Basic Function 1" category. CPU 110 terminates the control process, i.e. repeats the process from step S102.

When a setting related to a function corresponding to "Basic Function 2" is not accepted from the user (NO at step S102), a determination is made whether the currently selected setting has been canceled by the user or not (step S114). When the currently selected setting is not canceled (NO at step S114), CPU 110 terminates the control process, i.e. repeats the process from step S102.

When the currently selected setting is canceled (YES at step S114), CPU 110 determines whether the setting changed in conjunction with the relevant setting is stored in RAM 103 at step S106 (step S116). When a setting changed in conjunction with the relevant setting is not stored in RAM 103 at step S106 (NO at step 116), the control process is terminated, i.e. the process starting from step S102 is repeated.

When a setting changed in conjunction with the relevant setting is stored in RAM 103 at step S106 (YES at step S116), CPU 110 terminates the emphasized display of software button 1311 indicating the "Basic Function 1" category corresponding to the function whose setting was changed automatically in conjunction during the prior acceptance of the relevant setting (step S118). In other words, CPU 110 returns the display of touch panel 133 from the state of FIG. 6 (mark displayed state) to the information indicated in FIG. 5 (no mark state) on touch panel 133. Then, CPU 110 terminates the control process, i.e. repeats the process from step S102.

CPU 110 may cause touch panel 133 to display a mark on software button 131B directly representing the function modified by the user. CPU 110 may cause touch panel 133 to display a mark on software button 1312 indicating the category that includes the function changed by the user.

Second Embodiment

A second embodiment of the present invention will be described hereinafter. Image formation apparatus 100 according to the first embodiment described above is directed to modifying the display manner of software button 1311 indicating the second category from the former display manner, when the setting of a function in a category (second category) other than the currently selected category (first category) is automatically changed.

An image formation apparatus 100 of the second embodiment causes, when the setting of a function in a category (second category) other than the currently selected category (first category) is automatically changed, the display manner of software button 1311 indicating the second category to be modified from the former display manner, and displays the software button indicating the function whose setting has been automatically changed.

The remaining configuration of the second embodiment is similar to the configuration of image formation apparatus 100 of the first embodiment. Therefore, description thereof will not be repeated. For example, the overall configuration of image formation apparatus 100, the configuration of the print engine portion of image formation apparatus 100, and the hardware configuration of image formation apparatus 100 of the present embodiment are similar to those of the first embodiment shown in FIGS. 1-3. Therefore, description thereof will not be repeated.

Schematic Operation Related to User Interface

A schematic operation related to a user interface according to the present embodiment will be described hereinafter. In the present embodiment, CPU 110 implements a user interface set forth below utilizing touch panel 133.

Similarly in the present embodiment, a function relation table representing the relationship between a plurality of functions is stored in RAM 103. For example, when the setting of any of the functions corresponding to "Basic Function 2" is changed, there is the case where CPU 110 automatically changes the setting of a function corresponding to "Basic Function 1" or "Extended Function". The following description is based on the case where the "booklet" function belonging to the "Basic Function 2" category is set to "right-to-left folded".

Figure 8:
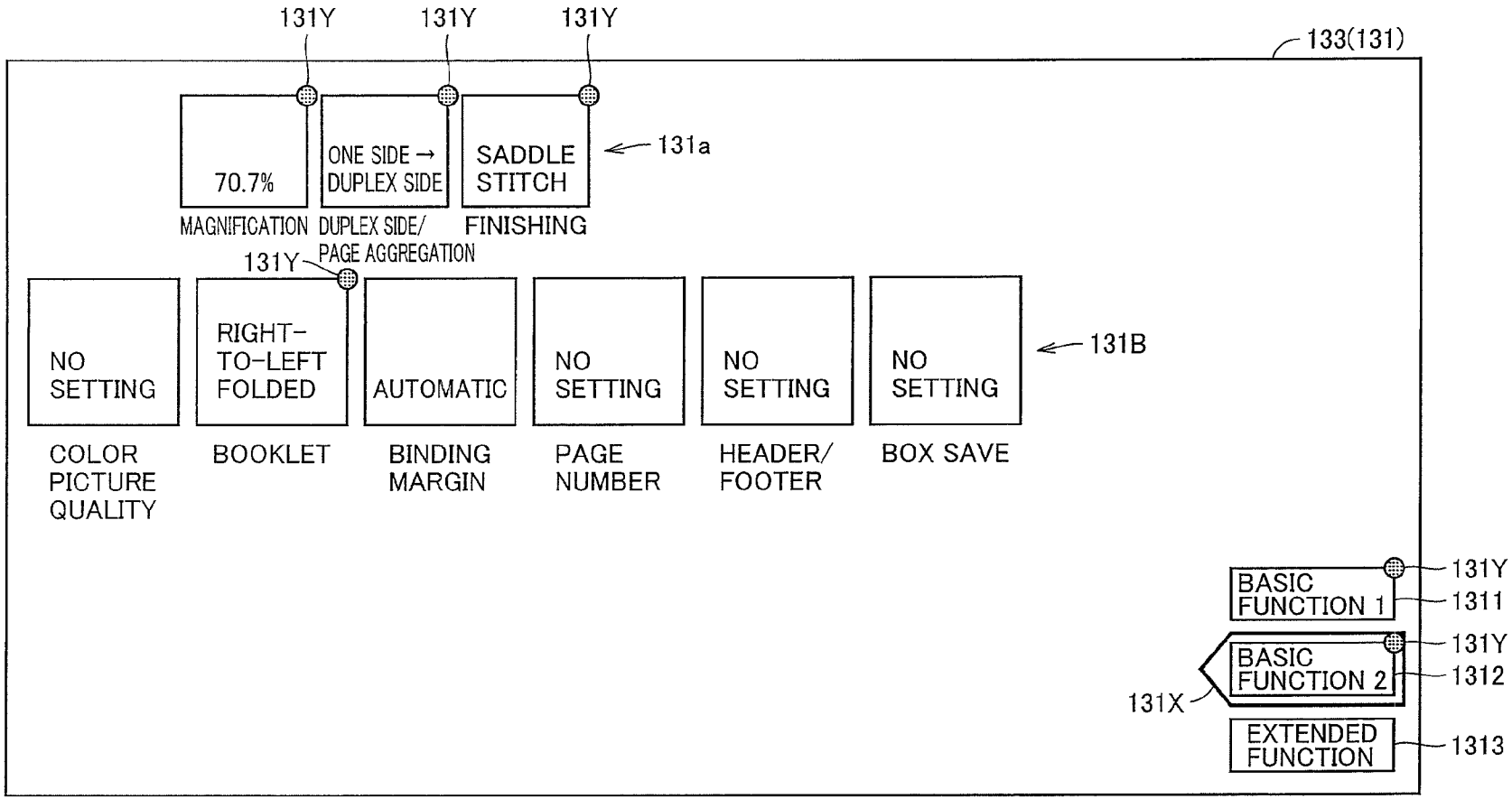
FIG. 8 is a pictorial representation of touch panel 133 when the "booklet" function belonging to a category "Basic Function 2" is set at "right-to-left folded" according to the second embodiment.

Referring to the pictorial representation of touch panel 133 in FIG. 8, CPU 110 refers to the function relation table to reset automatically the functions belonging to category "Basic Function 1", when the "booklet" function belonging to category "Basic Function 2" is set at "right-to-left folded".

More specifically, when the "booklet" function belonging to the "Basic Function 2" category is set at "right-to-left folded", CPU 110 sets the "magnification" function belonging to the "Basic Function 1" category to "70.7%", the "duplex side/page aggregation" function belonging to the "Basic Function 1" category to "one side→duplex side", and the "finishing" function belonging to the "Basic Function 1" category to "saddle stitch".

In response to the change in the setting of the function in "Basic Function 2", CPU 110 determines whether the setting of a function corresponding to "Basic Function 1" or "Extended Function" has been changed automatically or not. When the setting of a function belonging to category "Basic Function 1", differing from "Basic Function 2", has been changed automatically, the display manner of button 1311 of the relevant "Basic Function 1" is modified from the former display manner.

Similarly in the present embodiment, CPU 110 causes touch panel 133 to display mark 131Y on button 1311 indicating "Basic Function 1". CPU 110 also causes touch panel 133 to display mark 131Y on button 1312 indicating currently selected "Basic Function 2". In other words, CPU 110 modifies the display manner of a software button indicating the category to which the function whose setting has been changed by the user belongs to and the display manner of a software button indicating the category to which the function whose setting has been changed automatically by the relevant change belongs to, each from the former display manner.

Particularly, in the present embodiment, CPU 110 causes touch panel 133 to display, not only software button 131B indicating the function belonging to the currently selected category, but also software button 131*a* indicating the function whose setting has been changed automatically. With regard to a function that does not belong to the currently selected category, a software button 131*a* corresponding to any function whose setting has been changed automatically is displayed on touch panel 133.

CPU 110 responds to a depression of, not only software button 131B indicating the function to which the currently selected category belongs to, but also software button 131*a* corresponding to the function whose setting has been changed automatically to accept a modification instruction of a setting related to the function corresponding to the relevant software button 131*a*. Therefore, execution of a job under a setting not intended by the user can be readily prevented.

Thus, the present embodiment allows the user to be notified that the setting of a function not belonging to the currently selected category has been changed automatically. Particularly, the user can be notified of the category to which the function whose setting has been changed automatically belongs to in the present embodiment.

Control Method

A control process at image formation apparatus 100 of the present embodiment will be described hereinafter with reference to the flowchart of FIG. 9. In the following, it is assumed that "Basic Function 2" is selected as the category. In other words, it is assumed that CPU 110 provides the display of software buttons 131B indicating the functions corresponding to "Basic Function 2" on touch panel 133 in a selectable manner.

Figure 9:
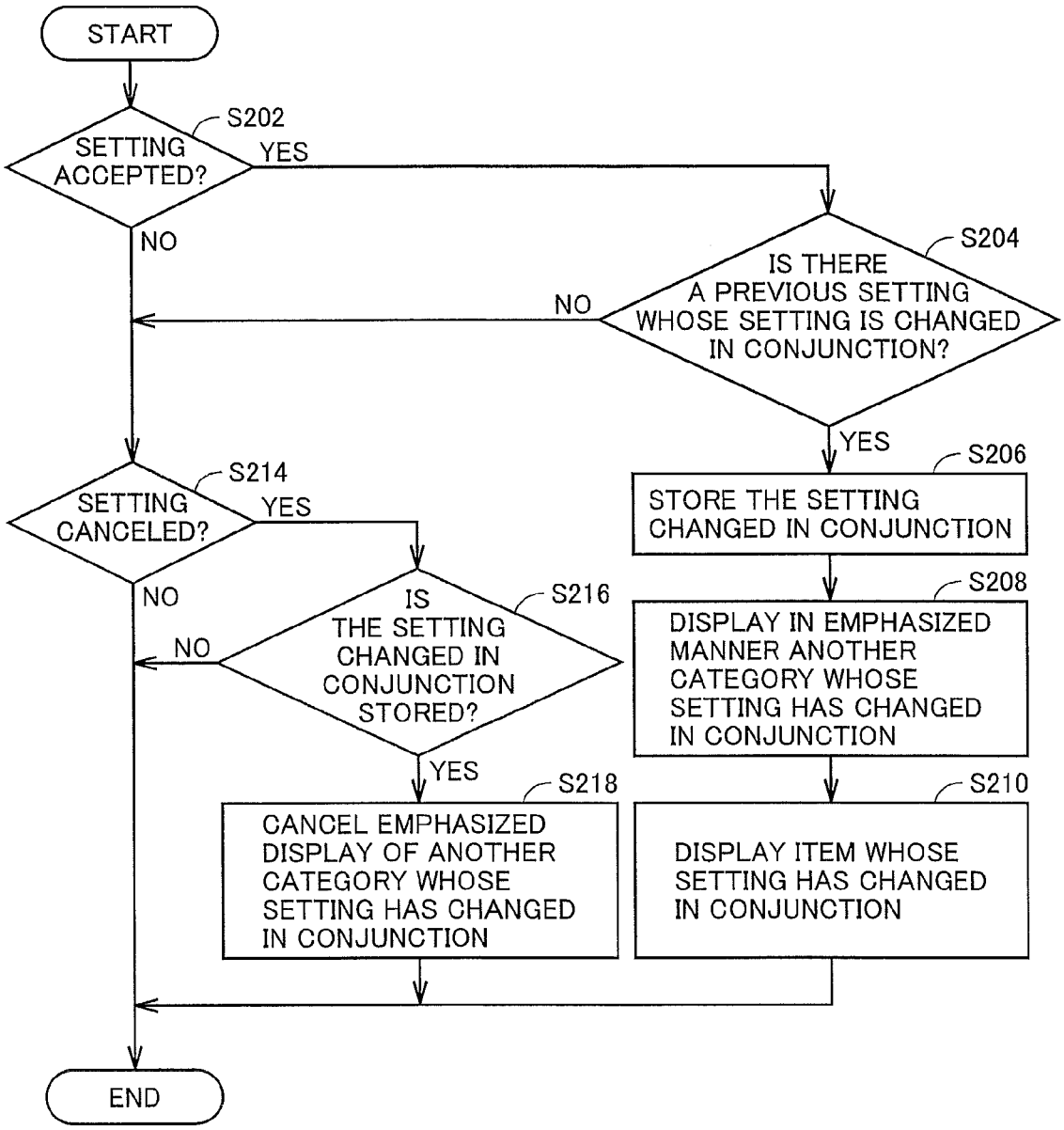
FIG. 9 is a flowchart of a control process at image formation apparatus 100 according to the second embodiment.

Referring to FIG. 9, CPU 110 determines whether a setting related to a function corresponding to "Basic Function 2" has been accepted from the user through touch panel 133 (step S202). When a setting related to a function corresponding to "Basic Function 2" is not accepted from the user (NO at step S202), CPU 110 executes the process starting from step S214.

When a setting related to a function corresponding to "Basic Function 2" is accepted from the user (YES at step S202), CPU 110 refers to the function relation table to determine whether there is a function whose setting is changed automatically in conjunction with the relevant setting, among the functions corresponding to "Basic Function 1" or "Extended Function" (step S204). When there is no function whose setting will be automatically changed in conjunction with the relevant setting among the functions corresponding to "Basic Function 1" or "Extended Function" (NO at step S204), CPU 110 executes the process starting from step S214.

When there is a function whose setting is to be changed automatically in conjunction with the relevant setting among the functions corresponding to "Basic Function 1" or "Extended Function" (YES at step S204), CPU 110 stores the setting changed automatically in conjunction with the relevant setting in RAM 103 (step S206).

Then, as shown in FIG. 8, CPU 110 causes touch panel 133 to display, in an emphasized manner, software button 1311 indicating the "Basic Function 1" category corresponding to the function whose setting was changed automatically in conjunction with the relevant setting (step S208). In other words, CPU 110 provides the display of a mark on software button 1311 indicating the "Basic Function 1" category. Following the display of software button 131*a* of a function whose setting has been changed automatically on touch panel 133, CPU 110 further provides an emphasized display of those software buttons 131*a*. CPU 110 causes touch panel 133 to display, in an emphasized manner, the function automatically set as software button 131*a* (step S210). CPU 110 ends the control process, i.e. repeats the process starting from step S202.

When a setting related to a function corresponding to "Basic Function 2" is not accepted from the user (NO at step S202), CPU 110 determines whether the currently selected setting has been canceled by the user (step S214). When the currently selected setting is not canceled (NO at step S214), CPU 110 terminates the control process, i.e. repeats the process starting from step S202.

When the currently selected setting is canceled (YES at step S214), CPU 110 determines whether the setting changed in conjunction with the relevant setting is stored in RAM 103 at step S206 (step S216). When a setting changed in conjunction with the relevant setting is not stored in RAM 103 at step S206 (NO at step 216), the control process is terminated, i.e. the process starting from step S202 is repeated.

When a setting changed in conjunction with the relevant setting is stored in RAM 103 at step S206 (YES at step S216), CPU 110 terminates the emphasized display of software button 1311 indicating the "Basic Function 1" category corresponding to the function whose setting was changed automatically in conjunction during the prior acceptance of the relevant setting (step S218). In other words, CPU 110 returns the display of touch panel 133 from the state of FIG. 8 (mark displayed state) to the information indicated in FIG. 5 (no mark state) on touch panel 133. Then, CPU 110 terminates the control process, i.e. repeats the process from step S202.

CPU 110 may cause touch panel 133 to display a mark on software button 131B directly representing the function modified by the user. CPU 110 may cause touch panel 133 to display a mark on software button 1312 indicating the category that includes the function changed by the user.

Object Display Termination Process 1

Figure 10:
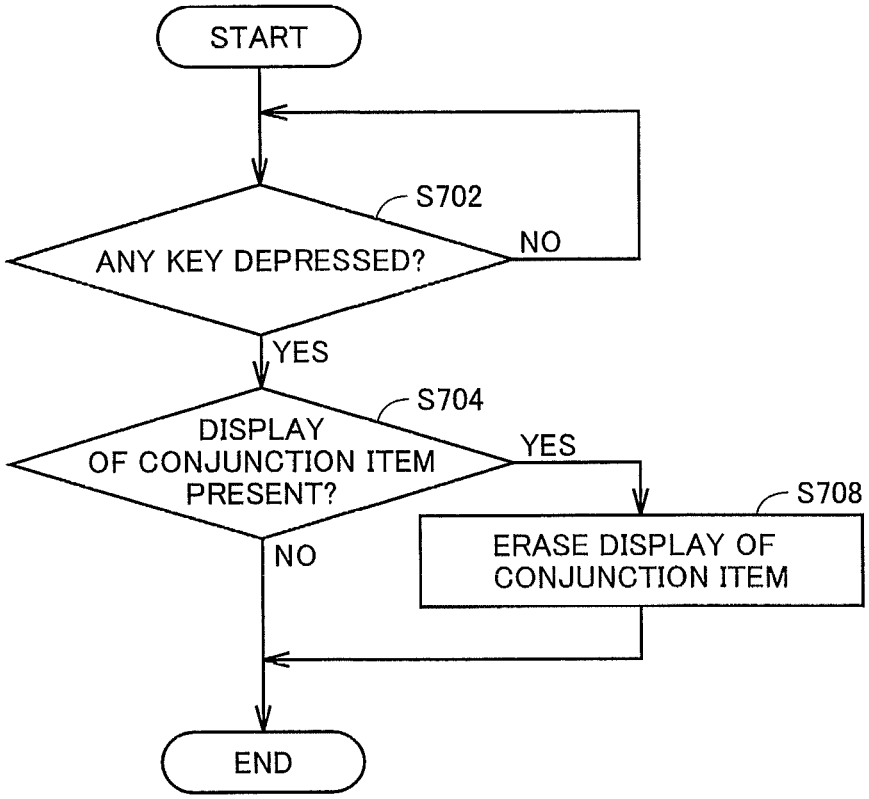
FIG. 10 is a flowchart of a first object display termination process at image formation apparatus 100 according to the present embodiment.

A first process to terminate the display of an object (for example, software button 131*a* or the like) indicating a function whose setting has been changed automatically will be described hereinafter. In other words, the specific process executed at step S218 in the flowchart of FIG. 9 will be described. FIG. 10 is a flowchart of the first object display termination process at image formation apparatus 100 of the present embodiment.

Referring to FIG. 10, CPU 110 determines whether the user has depressed any of a software button and hardware button via touch panel 133 and hardware button 134 (step S702). When CPU 110 determines that the user has not depressed any of the software button and hardware button (NO at step S702), the process of step S702 is repeated.

When a determination is made that the user has depressed any of the software button and hardware button (YES at step S702), CPU 110 determines whether an object indicating the function whose setting has been changed automatically is displayed or not (step S704). When an object indicating a function whose setting has been changed automatically is not displayed (NO at step S704), CPU 110 ends the object display termination process.

When an object indicating a function whose setting has been changed automatically is displayed (YES at step S704), CPU 110 terminates the display of the relevant object on touch panel 133 (step S708). CPU 110 ends the object display termination process.

When an operation is newly accepted from the user under the state where an object indicating a function whose setting has been changed automatically is displayed in object display termination process 1, the display of the relevant object is terminated. In other words, an object indicating a function whose setting has been changed automatically is displayed until an operation is newly accepted from the user.

Object Display Termination Process 2

Figure 11:
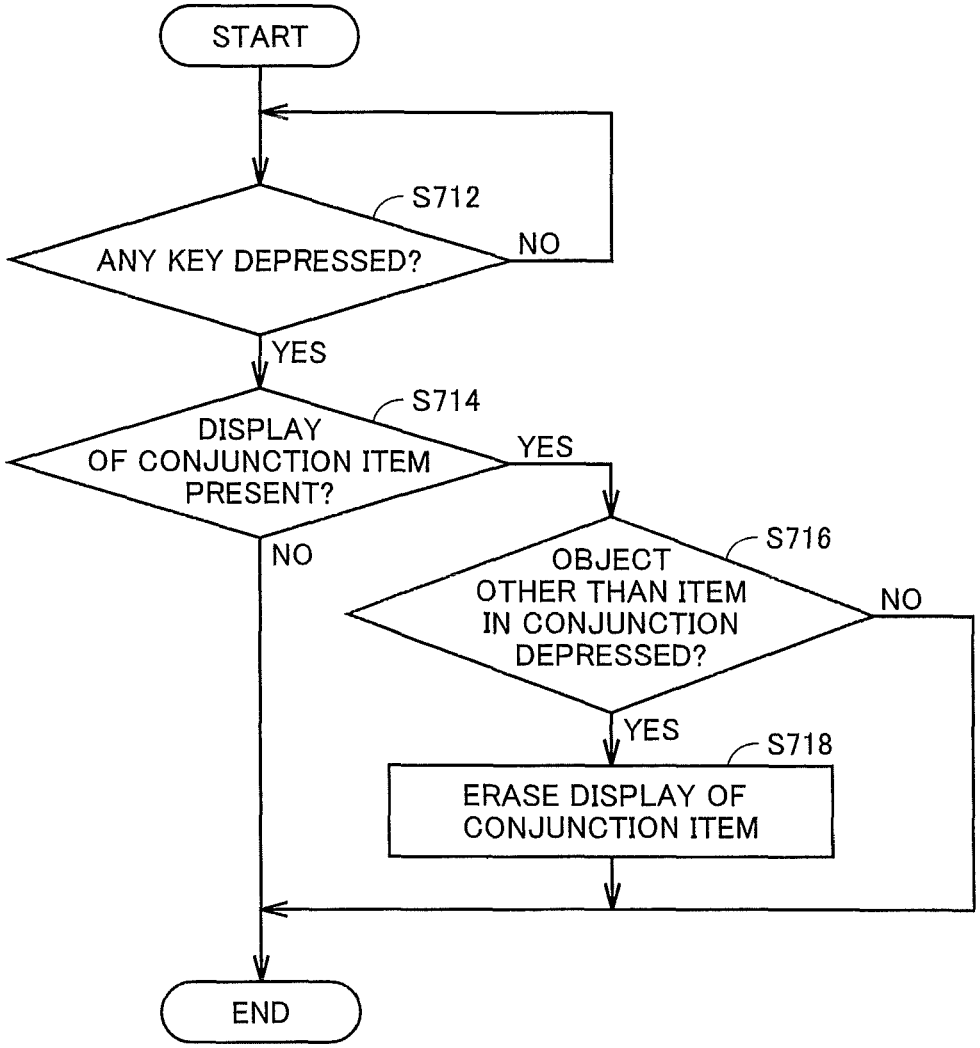
FIG. 11 is a flowchart of a second object display termination at image formation apparatus 100 according to the present embodiment.

A second process to terminate the display of an object indicating a function whose setting has been changed automatically will be described hereinafter. FIG. 11 is a flowchart of the second object display termination process at image formation apparatus 100 of the present embodiment.

Referring to FIG. 11, CPU 110 determines whether the user has depressed any of a software button and hardware button via touch panel 133 and hardware button 134 (step S712). When CPU 110 determines that the user has not depressed any of the software button and hardware button (NO at step S712), the process of step S712 is repeated.

When a determination is made that the user has depressed any of the software button and hardware button (YES at step S712), CPU 110 determines whether an object indicating a function whose setting has been changed automatically is displayed or not (step S714). When an object indicating a function whose setting has been changed automatically is not displayed (NO at step S714), CPU 110 ends the object display termination process.

When an object indicating a function whose setting has been changed automatically is displayed (YES at step S714), CPU 110 determines whether an object other than the relevant object is depressed or not through touch panel 133 by the user (step S716). When the user has depressed a relevant object (NO at step S716), CPU 110 ends the object display termination process.

When an object other than the relevant object is depressed by the user (YES at step S716), CPU 110 terminates the display of the relevant object on touch panel 133 (step S718). CPU 110 terminates the object display termination process.

Thus, when a function whose setting has been changed automatically is displayed and an operation corresponding to an object other than the object indicating the function whose setting has been changed automatically is accepted from the user in object display termination process 2, the display of the object indicating the function whose setting has been changed automatically is terminated. In other words, an object indicating a function whose setting has been changed automatically is displayed until an operation corresponding to an object other than the object indicating the function whose setting has been changed automatically is accepted from the user.

Object Display Termination Process 3

Figure 12:
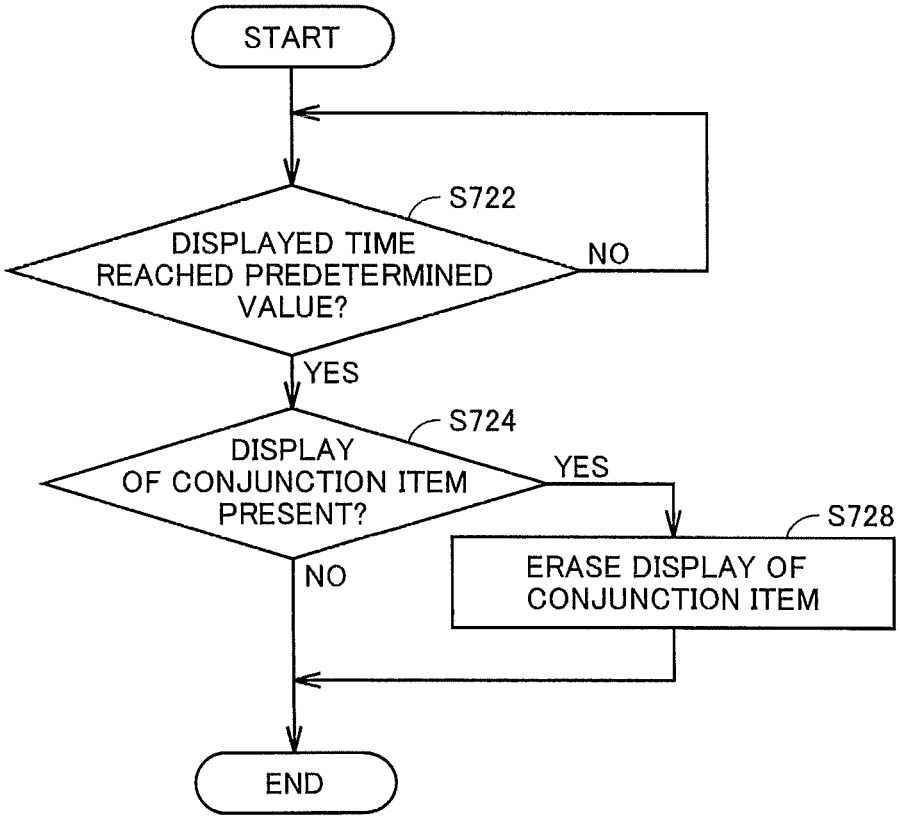
FIG. 12 is a flowchart of a third object display termination process at image formation apparatus 100 according to the present embodiment.

A third process to terminate the display of an object indicating a function whose setting has been changed automatically will be described hereinafter. FIG. 12 is a flowchart of a third object display termination process at image formation apparatus 100 of the present embodiment. When an object belonging to a category other than the currently selected category, for example software button 131*a* indicating a function whose setting has been changed automatically, is displayed, timer 139 begins to count the displayed time thereof.

Referring to FIG. 12, CPU 110 obtains a displayed time of an object belonging to a category other than the currently selected category from timer 139. CPU 110 determines whether the displayed time has reached a predetermined value (step S722). When CPU 110 determines that the displayed time has not reached the predetermined value (NO at step S722), the process starting from step S722 is repeated.

When a determination is made that the displayed time has reached the predetermined value (YES at step S722), CPU 110 determines whether an object indicating a function whose setting has been changed automatically is displayed or not (step S724). When an object displaying a function whose setting has been changed automatically is not displayed (NO at step S724), CPU 110 ends the object display termination process.

When an object indicating a function whose setting has been changed automatically is displayed (YES at step S724), CPU 110 causes touch panel 133 to terminate the display of the relevant object (step S728). CPU 110 ends the object display termination process.

Thus, when the displayed time of an object indicating a function whose setting has been changed automatically reaches the predetermined value in object display termination process 3, the display of the relevant object is terminated. In other words, the relevant object is displayed until the displayed time of the object indicating a function whose setting has been changed automatically reaches the predetermined value.

Exemplified Application of Object Display Termination Process

An exemplified application of a process to terminate the display of an object indicating a function whose setting has been changed automatically will be described hereinafter. Image formation apparatus 100 may employ any one of, or employ two or three of, the first to third object display termination processes set forth above.

Alternatively, a different object display termination process may be employed according to the category to which a function whose setting has been changed automatically belongs to. For example, when the category to which the function whose setting has been changed automatically belongs to is "Basic Function 1", "Basic Function 2", and "Extended Function", CPU 110 may execute the first object display termination process, the second object display termination process, and the third object display termination process, respectively. In this case, the corresponding relationship between a category and an object display termination process is stored in NV-RAM 101 or the like.

Figure 13:
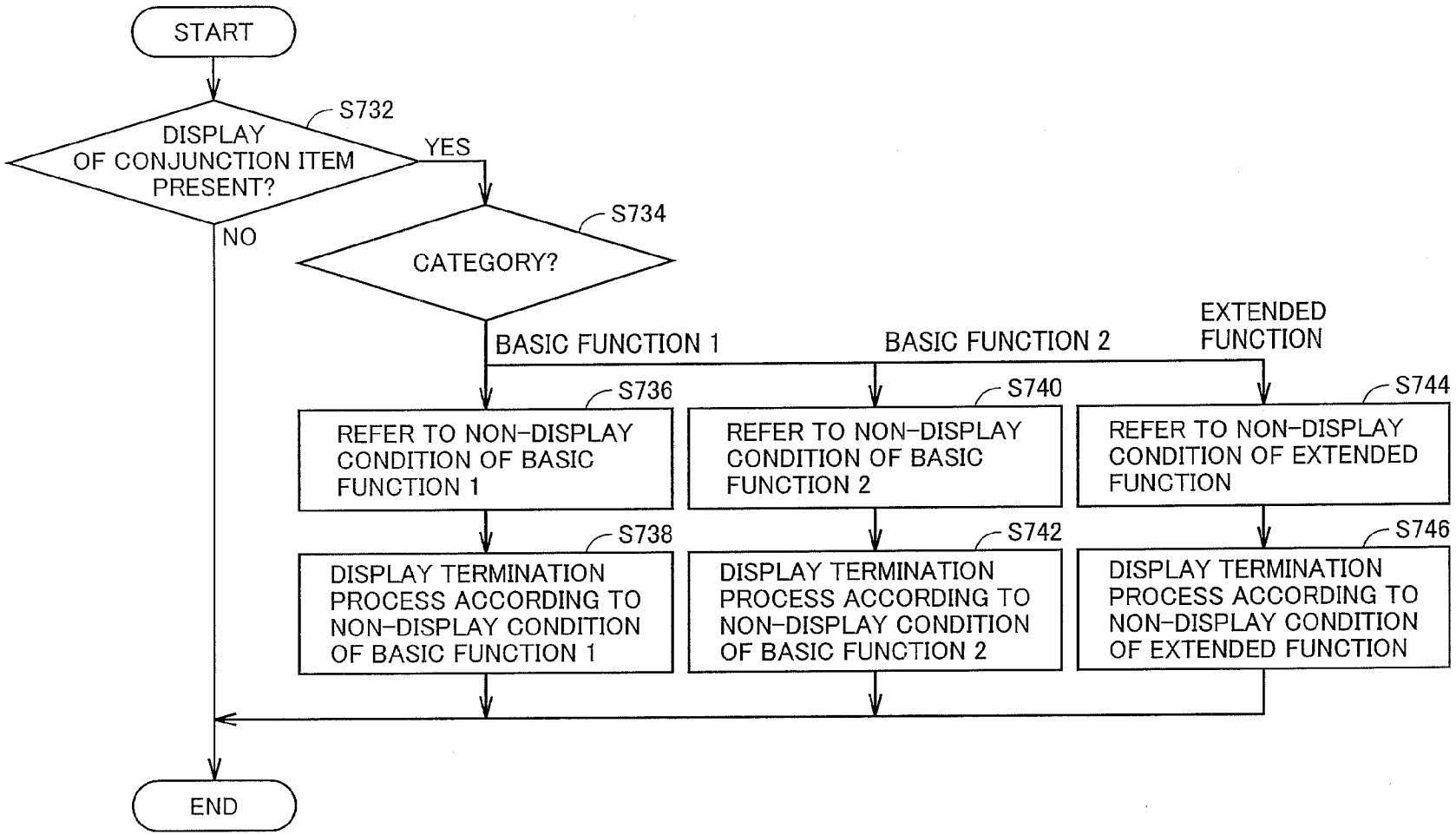
FIG. 13 is a flowchart representing an exemplified application of an object display termination process at image formation apparatus 100 according to the present embodiment.

In further detail, the specific control set forth below is provided. FIG. 13 is a flowchart of an exemplified application of an object display termination process at image formation apparatus 100 of the present embodiment. When an object belonging to a category other than the currently selected category, for example a software button 131*a* indicating a function whose setting has been changed automatically, is displayed, timer 139 begins to start counting the displayed time thereof.

Referring to FIG. 13, CPU 110 determines whether an object indicating a function whose setting has been changed is displayed or not (step S732). When an object whose setting has been changed is not displayed (NO at step S732), CPU 110 ends the object display termination process.

When an object whose setting has been changed is displayed (YES at step S732), CPU 110 identifies the category to which the function whose setting has been changed automatically belongs to (step S734).

When the category to which a function whose setting has been changed automatically belongs to is "Basic Function 1", CPU 110 reads out the object display termination process corresponding to "Basic Function 1" from NV-RAM 101 (step S736). CPU 110 executes the object display termination process corresponding to "Basic Function 1" (for example, the first object display termination process shown in FIG. 10) (step S738). CPU 110 ends the object display termination process.

When the category to which a function whose setting has been changed automatically belongs to is "Basic Function 2", CPU 110 reads out the object display termination process corresponding to "Basic Function 2" (step S740). CPU 110 executes the object display termination process corresponding to "Basic Function 2" (for example, the second object display termination process shown in FIG. 11) (step S742). CPU 110 ends the object display termination process.

When the category to which a function whose setting has been changed automatically belongs to is "Extended Function", CPU 110 reads out the object display termination process corresponding to "Extended Function" (step S744). CPU 110 executes the object display termination process corresponding to "Extended Function" (for example, the third object display termination process shown in FIG. 12) (step S746). CPU 110 ends the object display termination process.

Third Embodiment

A third embodiment of the present invention will be described hereinafter. Image formation apparatus 100 of the first embodiment described above is directed to modifying, when the setting of a function of a category (second category) other than the currently selected category (first category) has been changed automatically, the display manner of software button 1311 indicating the second category from the former display manner.

Image formation apparatus 100 of the third embodiment is directed to displaying, when the setting of a function of a category (second category) other than the currently selected category (first category) is automatically changed, modifying the display manner of software button 131 indicating the second category from the former display manner, and displaying software buttons 131*b* of all the functions belonging to the second category. Further, the display manner of the software button of the function belonging to the second category and whose setting has been changed automatically is differentiated from the display manner of a software button of a function belonging to the second category and whose setting has not been changed automatically.

The remaining configuration of the third embodiment is similar to the configuration of image formation apparatus 100 of the first embodiment. Therefore, description thereof will not be repeated. For example, the overall configuration of image formation apparatus 100, the configuration of the print engine portion of image formation apparatus 100, and the hardware configuration of image formation apparatus 100 of the present embodiment are similar to those of the first embodiment shown in FIGS. 1-3. Furthermore, the process to terminate the display of an object indicating a function whose setting has been changed automatically (for example, software button 131*b* or the like) is similar to that of the second embodiment, as shown in FIGS. 10-13. Therefore, description thereof will not be repeated.

Schematic Operation Related to User Interface

A schematic operation related to a user interface according to the third embodiment will be described hereinafter. In the present embodiment, CPU 110 implements a user interface set forth below utilizing touch panel 133.

Similarly in the present embodiment, a function relation table representing the relationship between a plurality of functions is stored in RAM 103. For example, when the setting of any of the functions corresponding to "Basic Function 2" is changed, there is the case where CPU 110 automatically changes the setting of a function corresponding to "Basic Function 1" or "Extended Function". The following description is based on the case where the "booklet" function belonging to the "Basic Function 2" category is set to "right-to-left folded".

Figure 14:
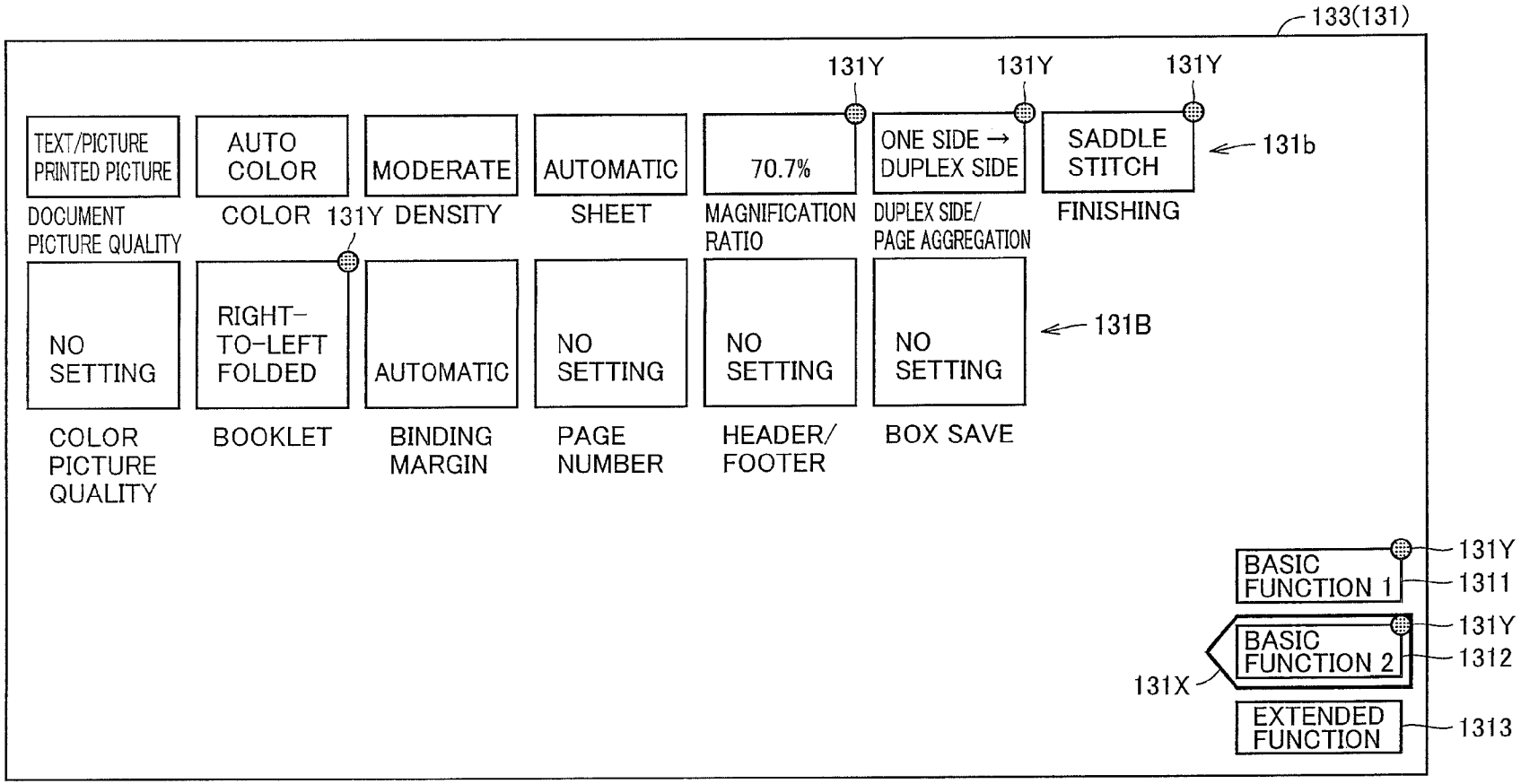
FIG. 14 is a pictorial representation of touch panel 133 when the "booklet" function belonging to a category "Basic Function 2" is set at "right-to-left folded" according to the third embodiment.

Referring to the pictorial representation of touch panel 133 in FIG. 14, CPU 110 refers to the function relation table to reset automatically the functions belonging to category "Basic Function 1", when the "booklet" function belonging to category "Basic Function 2" is set at "right-to-left folded".

More specifically, when the "booklet" function belonging to the "Basic Function 2" category is set at "right-to-left folded", CPU 110 sets the "magnification" function belonging to the "Basic Function 1" category to "70.7%", the "duplex side/page aggregation" function belonging to the "Basic Function 1" category to "one side→duplex side", and the "finishing" function belonging to the "Basic Function 1" category to "saddle stitch".

In response to the change in the setting of the function in "Basic Function 2", CPU 110 determines whether the setting of a function corresponding to "Basic Function 1" or "Extended Function" has been changed automatically or not. When the setting of a function belonging to the "Basic Function 1" category, differing from "Basic Function 2", has been changed automatically, the display manner of button 1311 of the relevant "Basic Function 1" is modified from the former display manner.

Similarly in the present embodiment, CPU 110 causes the display of mark 131Y on button 1311 indicating "Basic Function 1". CPU 110 also causes the display of mark 131Y on button 1312 indicating currently selected "Basic Function 2". In other words, CPU 110 modifies the display manner of a software button indicating the category to which the function whose setting has been changed by the user belongs to and the display manner of a software button indicating the category to which the function whose setting has been changed automatically by the relevant change belongs to, each from the former display manner.

Particularly, in the present embodiment, CPU 110 causes touch panel 133 to display, not only software button 131B indicating the function belonging to the currently selected category (first category), but also all software buttons 131*b* belonging to the category (second category) corresponding to the function whose setting has been changed automatically. Software button 131*b* belonging to the second category is smaller than the software button the belonging to the first category. The display manner of the software button indicating the function belonging to the second category and whose setting has been changed automatically is differentiated from the display manner of a software button indicating a function belonging to the second category and whose setting has not been changed automatically.

CPU 110 responds to a depression of, not only software button 131B indicating the function to which the currently selected category belongs to, but also software button 131*b* corresponding to the function whose setting has been changed automatically to accept a modification instruction of a setting related to the function corresponding to the relevant software button 131*b*. Therefore, execution of a job under a setting not intended by the user can be readily prevented.

Thus, the present embodiment allows the user to be notified that the setting of a function not belonging to the currently selected category has been changed automatically. Particularly, the user can be notified of the category to which the function whose setting has been changed automatically belongs to in the present embodiment.

Control Method

A control process at image formation apparatus 100 of the present embodiment will be described hereinafter with reference to the flowchart of FIG. 15. In the following, it is assumed that "Basic Function 2" is selected as the category. In other words, it is assumed that CPU 110 provides the display of software buttons 131B indicating the functions corresponding to "Basic Function 2" on touch panel 133 in a selectable manner.

Figure 15:
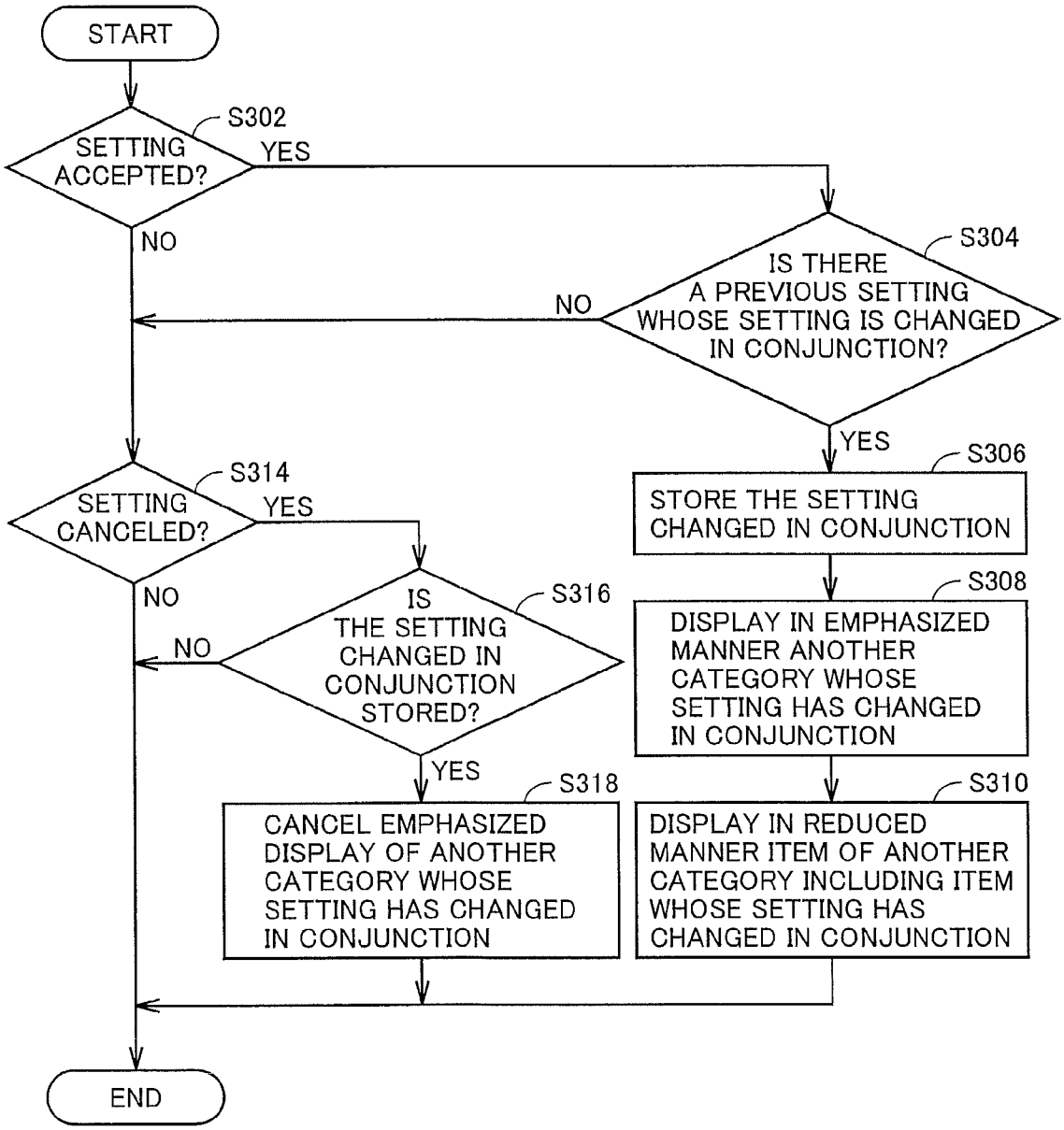
FIG. 15 is a flowchart of a control process at image formation apparatus 100 according to a third embodiment.

Referring to FIG. 15, CPU 110 determines whether a setting related to a function corresponding to "Basic Function 2" has been accepted from the user through touch panel 133 (step S302). When a setting related to a function corresponding to "Basic Function 2" is not accepted from the user (NO at step S302), CPU 110 executes the process starting from step S314.

When a setting related to a function corresponding to "Basic Function 2" is accepted from the user (YES at step S302), CPU 110 refers to the function relation table to determine whether there is a function whose setting is changed automatically in conjunction with the relevant setting, among the functions corresponding to "Basic Function 1" or "Extended Function" (step S304). When there is no function whose setting will be automatically changed in conjunction with the relevant setting among the functions corresponding to "Basic Function 1" or "Extended Function" (NO at step S304), CPU 110 executes the process starting from step S314.

When there is a function whose setting is to be changed automatically in conjunction with the relevant setting among the functions corresponding to "Basic Function 1" or "Extended Function" (YES at step S304), CPU 110 stores the setting changed automatically in conjunction with the relevant setting in RAM 103 (step S306).

Then, as shown in FIG. 14, CPU 110 causes touch panel 133 to display, in an emphasized manner, software button 1311 indicating the "Basic Function 1" category corresponding to the function whose setting was changed automatically in conjunction with the relevant setting (step S308). Further, CPU 110 causes touch panel 133 to display the function belonging to the "Basic Function 1" category as software button 131*b* (step S310).

Software button 131*b* corresponding to a function belonging to the "Basic Function 1" category is smaller than software button 131B corresponding to the function belonging to the "Basic Function 2" category. Further, CPU 110 cause touch panel 133 to display, in an emphasized manner, the software button corresponding to the function whose setting has been changed automatically. CPU 110 terminates the control process, i.e. repeats the process starting from step S302.

When a setting related to a function corresponding to "Basic Function 2" is not accepted from the user (NO at step S302), CPU 110 determines whether the currently selected setting has been canceled by the user (step S314). When the currently selected setting is not canceled (NO at step S314), CPU 110 terminates the control process, i.e. repeats the process starting from step S302.

When the currently selected setting is canceled (YES at step S314), CPU 110 determines whether the setting changed in conjunction with the relevant setting is stored in RAM 103 at step S306 (step S316). When a setting changed in conjunction with the relevant setting is not stored in RAM 103 at step S306 (NO at step 316), the control process is terminated, i.e. the process starting from step S302 is repeated.

When a setting changed in conjunction with the relevant setting is stored in RAM 103 at step S306 (YES at step S316), CPU 110 terminates the emphasized display of software button 1311 indicating the "Basic Function 1" category corresponding to the function whose setting was changed automatically in conjunction during the prior acceptance of the relevant setting (step S318). In other words, CPU 110 returns the display of touch panel 133 from the state of FIG. 14 (mark displayed state) to the information indicated in FIG. 5 (no mark state) on touch panel 133. Then, CPU 110 terminates the control process, i.e. repeats the process from step S302.

CPU 110 may cause touch panel 133 to display a mark on software button 131B directly representing the function modified by the user. CPU 110 may cause touch panel 133 to display a mark on software button 1312 indicating the category that includes the function changed by the user.

Fourth Embodiment

A fourth embodiment of the present embodiment will be described hereinafter.

Image formation apparatus 100 according to the first embodiment described above is directed to modifying the display manner of software button 1311 indicating the second category from the former display manner, when the setting of a function in a category (second category) other than the currently selected category (first category) is automatically changed.

Figure 16:
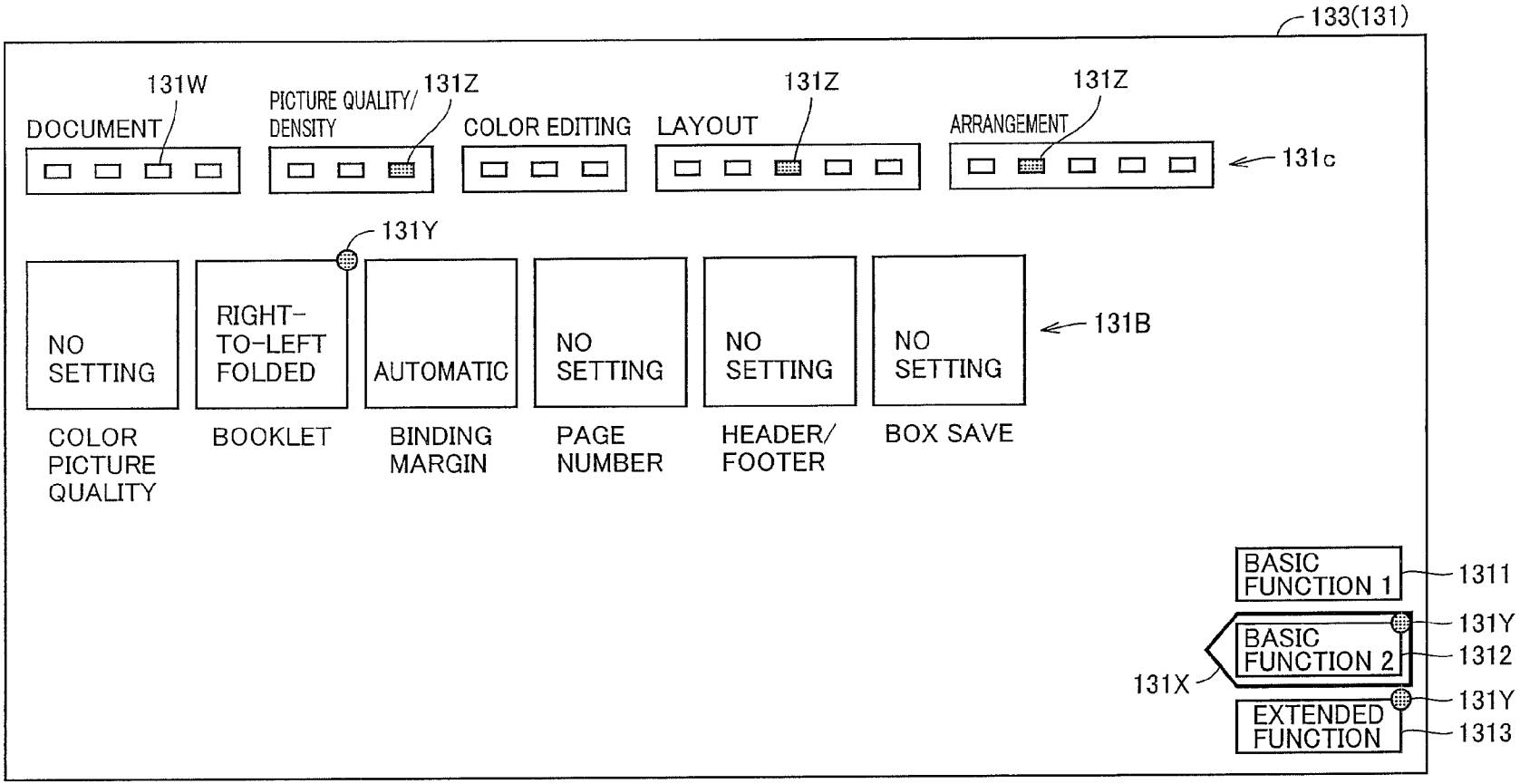
FIG. 16 is a pictorial representation of touch panel 133 when the "booklet" function belonging to a category "Basic Function 2" is set at "right-to-left folded" according to a fourth embodiment.

In contrast, image formation apparatus 100 of the fourth embodiment modifies, when the setting of a function of a category (second category) other than the currently selected category (first category) is changing automatically, the display manner of software button 1313 indicating the second category, and displays an object indicating each of the functions belonging to the second category as a function bar 131*c* (refer to FIG. 16). The display manner of an object (mark 131Z) of a function belonging to the second category and whose setting has been changed automatically is differentiated from the display manner of an object (mark 131W) of a function belonging to the second category and whose setting is not changed automatically.

In the following, the description of a configuration of image formation apparatus 100 similar to that of the first embodiment will not be repeated. For example, the overall configuration of image formation apparatus 100, the configuration of the print engine portion of image formation apparatus 100, and the hardware configuration of image formation apparatus 100 of the fourth embodiment are similar to those of the first embodiment shown in FIGS. 1-3. Further, the process to terminate the display of an object (for example, mark 131Z, or the like) indicating a function whose setting has been changed automatically is similar to that of the second embodiment described with reference to FIGS. 10-13. Therefore, description thereof will not be repeated.

Schematic Operation Related to User Interface

A schematic operation related to a user interface according to the present embodiment will be described hereinafter. In the present embodiment, CPU 110 implements a user interface set forth below utilizing touch panel 133.

Similarly in the present embodiment, a function relation table representing the relationship between a plurality of functions is stored in RAM 103. For example, when the setting of any of the functions corresponding to "Basic Function 2" is changed, there is the case where CPU 110 automatically changes the setting of a function corresponding to "Basic Function 1" or "Extended Function". The following description is based on the case where the "booklet" function belonging to the "Basic Function 2" category is set to "right-to-left folded".

Referring to the pictorial representation of touch panel 133 in FIG. 16, CPU 110 refers to the function relation table to reset automatically the functions belonging to the "Extended Function" category, when the "booklet" function belonging to the "Basic Function 2" category is set at "right-to-left folded".

More specifically, when the "booklet" function belonging to the "Basic Function 2" category is set at "right-to-left folded" in the present embodiment, CPU 110 sets the "magnification" function in the "picture quality/density" section belonging to the "Extended Function" category to "70.7%", the "duplex side/page aggregation" function in the "layout" section "belonging to the "Extended Function" category to "one side→duplex side", and the finishing" function in the "arrangement" section belonging to the "Extended Function" category to "saddle stitch".

A section refers to a group including a plurality of functions similar to each other. In other words, each of the plurality of functions is classified into any one of the sections according to the type of function.

In response to the change in the setting of a function in "Basic Function 2", CPU 110 determines whether the setting of a function corresponding to "Basic Function 1" or "Extended Function" has been changed automatically or not. When the setting of a function belonging to category "Extended Function", differing from "Basic Function 2", has been changed, the display manner of button 1313 of the relevant "Extended Function" is modified from the former display manner.

Similarly in the present embodiment, CPU 110 causes touch panel 133 to display mark 131Y on button 1313 indicating "Extended Function". CPU 110 also causes touch panel 133 to display mark 131Y on button 1312 indicating currently selected "Basic Function 2". In other words, CPU 110 modifies the display manner of a software button indicating the category to which the function whose setting has been changed by the user belongs to and the display manner of a software button indicating the category to which the function whose setting has been changed automatically by the relevant change belongs to, each from the former display manner.

Particularly, in the present embodiment, CPU 110 causes touch panel 133 to display, not only software button 131B indicating the function belonging to the currently selected category (first category), but also objects indicating all the functions whose setting has been changed automatically and belonging to the currently selected category (second category) as function bar 131*c*. The display manner of an object 131Z of a function belonging to the second category and whose setting has been changed automatically is differentiated from the display manner of an object 131W of a function belonging to the second category and whose setting is not changed automatically.

Thus, the user can be notified that the setting of a function not belonging to the currently selected category has been modified automatically in the present embodiment. Particularly, the user can be notified of a category to which the function whose setting has been changed automatically belongs to and the relevant function.

Control Method

A control process at image formation apparatus 100 of the present embodiment will be described hereinafter with reference to the flowchart of FIG. 17. In the following, it is assumed that "Basic Function 2" is selected. In other words, it is assumed that CPU 110 provides the display of software buttons 131B indicating the functions corresponding to "Basic Function 2" on touch panel 133 in a selectable manner, as shown in FIG. 5.

Figure 17:
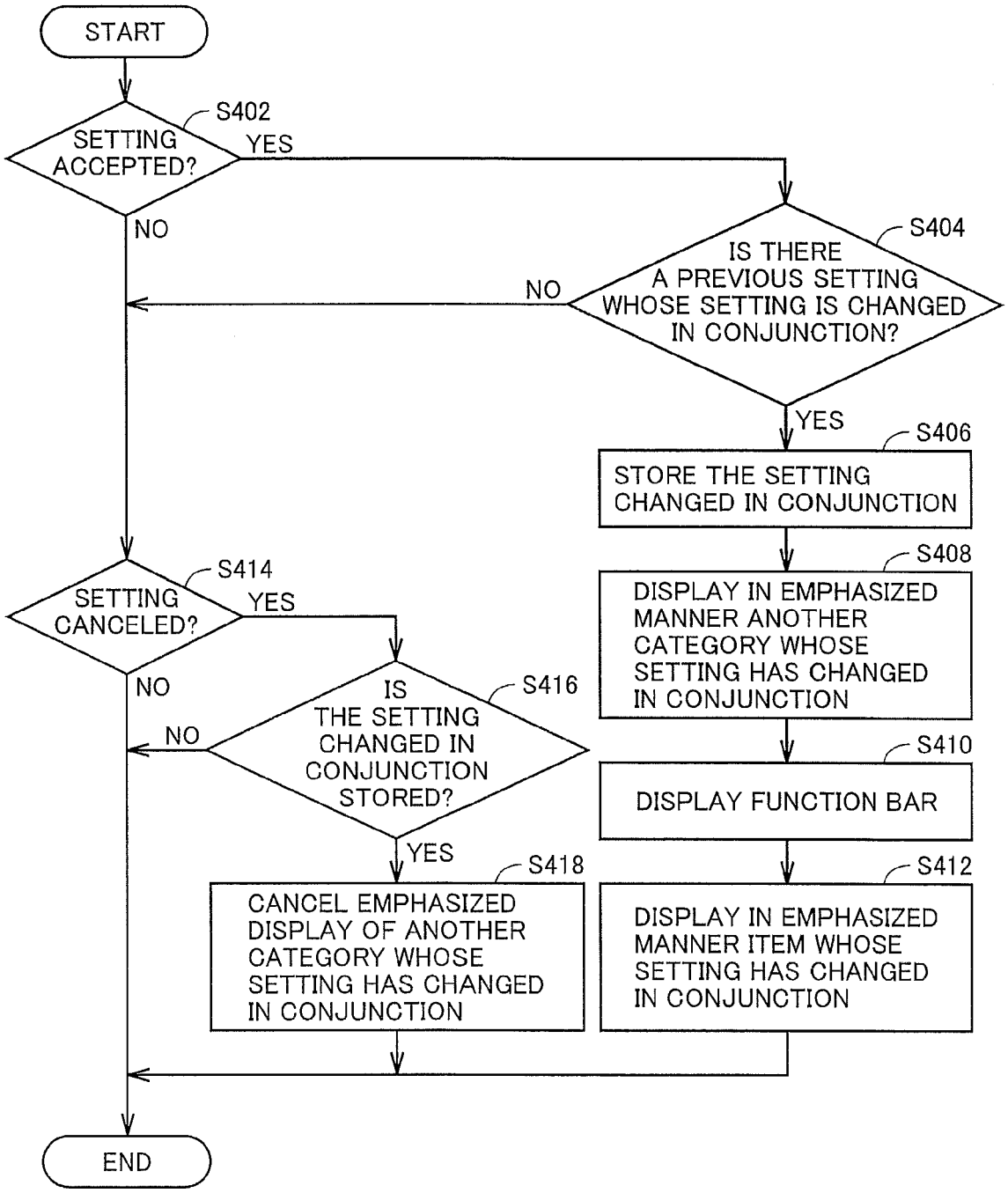
FIG. 17 is a flowchart of a control process at image formation apparatus 100 according to the fourth embodiment.

Referring to FIG. 17, CPU 110 determines whether a setting related to a function corresponding to "Basic Function 2" has been accepted from the user through touch panel 133 (step S402). When a setting related to a function corresponding to "Basic Function 2" is not accepted from the user (NO at step S402), CPU 110 executes the process starting from step S414.

When a setting related to a function corresponding to "Basic Function 2" is accepted from the user (YES at step S402), CPU 110 refers to the function relation table to determine whether there is a function whose setting is changed automatically in conjunction with the relevant setting, among the functions corresponding to "Basic Function 1" or "Extended Function" (step S404). When there is no function whose setting will be automatically changed in conjunction with the relevant setting among the functions corresponding to "Basic Function 1" or "Extended Function" (NO at step S404), CPU 110 executes the process starting from step S414.

When there is a function whose setting is to be changed automatically in conjunction with the relevant setting among the functions corresponding to "Basic Function 1" or "Extended Function" (YES at step S404), CPU 110 stores the setting changed automatically in conjunction with the relevant setting in RAM 103 (step S406).

Then, as shown in FIG. 16, CPU 110 causes touch panel 133 to display, in an emphasized manner, software button 1313 indicating the "Extended Function" category corresponding to the function whose setting was changed automatically in conjunction with the relevant setting (step S408). In other words, CPU 110 provides the display of functions belonging to the "Extended Function" category as function bar 131*c* on touch panel 133 (step S410). Then, CPU 110 causes touch panel 133 to display, in an emphasized manner, object 131Z corresponding to the function whose setting has been changed automatically (step S412). CPU 110 ends the control process, i.e. repeats the process starting from step S402.

When a setting related to a function corresponding to "Basic Function 2" is not accepted from the user (NO at step S402), CPU 110 determines whether the currently selected setting has been canceled by the user (step S414). When the currently selected setting is not canceled (NO at step S414), CPU 110 terminates the control process, i.e. repeats the process starting from step S402.

When the currently selected setting is canceled (YES at step S414), CPU 110 determines whether the setting changed in conjunction with the relevant setting is stored in RAM 103 at step S406 (step S416). When a setting changed in conjunction with the relevant setting is not stored in RAM 103 at step S406 (NO at step 416), the control process is terminated, i.e. the process starting from step S402 is repeated.

When a setting changed in conjunction with the relevant setting is stored in RAM 103 at step S406 (YES at step S416), CPU 110 terminates the emphasized display of software button 1311 indicating the "Extended Function" category corresponding to the function whose setting was changed automatically in conjunction during the acceptance of the relevant setting (step S418). In other words, CPU 110 returns the display on touch panel 133 from the state of FIG. 16 (mark displayed state) to the information indicated in FIG. 5 (no mark state) on touch panel 133. Then, CPU 110 terminates the control process, i.e. repeats the process from step S402.

CPU 110 may cause touch panel 133 to display a mark on software button 131B directly representing the function modified by the user. CPU 110 may cause touch panel 133 to display a mark on software button 1312 indicating the category that includes the function changed by the user.

Fifth Embodiment

A fifth embodiment of the present invention will be described hereinafter. Image formation apparatus 100 according to the first embodiment described above is directed to modifying the display manner of software button 1311 indicating the second category from the former display manner, when the setting of a function in a category (second category) other than the currently selected category (first category) is automatically changed.

In contrast, image formation apparatus 100 of the fifth embodiment is directed to, when the setting of a function of a category (second category) other than the currently selected category (first category) is modified automatically, modifying the display manner of software button 1313 indicating a second category from the former display manner, and displaying the designation and setting contents corresponding to each of the functions belonging to the second category as an object in a list.

In the following, the description of a configuration of image formation apparatus 100 similar to that of the first embodiment will not be repeated. For example, the overall configuration of image formation apparatus 100, the configuration of the print engine portion of image formation apparatus 100, and the hardware configuration of image formation apparatus 100 of the present embodiment are similar to those of the first embodiment shown in FIGS. 1-3. Further, the process to terminate the display of an object (for example, designation of a mark, or the like) indicating a function whose setting has been changed automatically is similar to that of the second embodiment described with reference to FIGS. 10-13. Therefore, description thereof will not be repeated.

Schematic Operation Related to User Interface

A schematic operation related to a user interface according to the present embodiment will be described hereinafter. In the present embodiment, CPU 110 implements a user interface set forth below utilizing touch panel 133.

Similarly in the present embodiment, a function relation table representing the relationship between a plurality of functions is stored in RAM 103. For example, when the setting of any of the functions corresponding to "Basic Function 2" is changed, there is the case where CPU 110 automatically changes any setting of a function corresponding to "Basic Function 1" or "Extended Function". The following description is based on the case where the "booklet" function belonging to the "Basic Function 2" category is set to "right-to-left folded".

Figure 18:
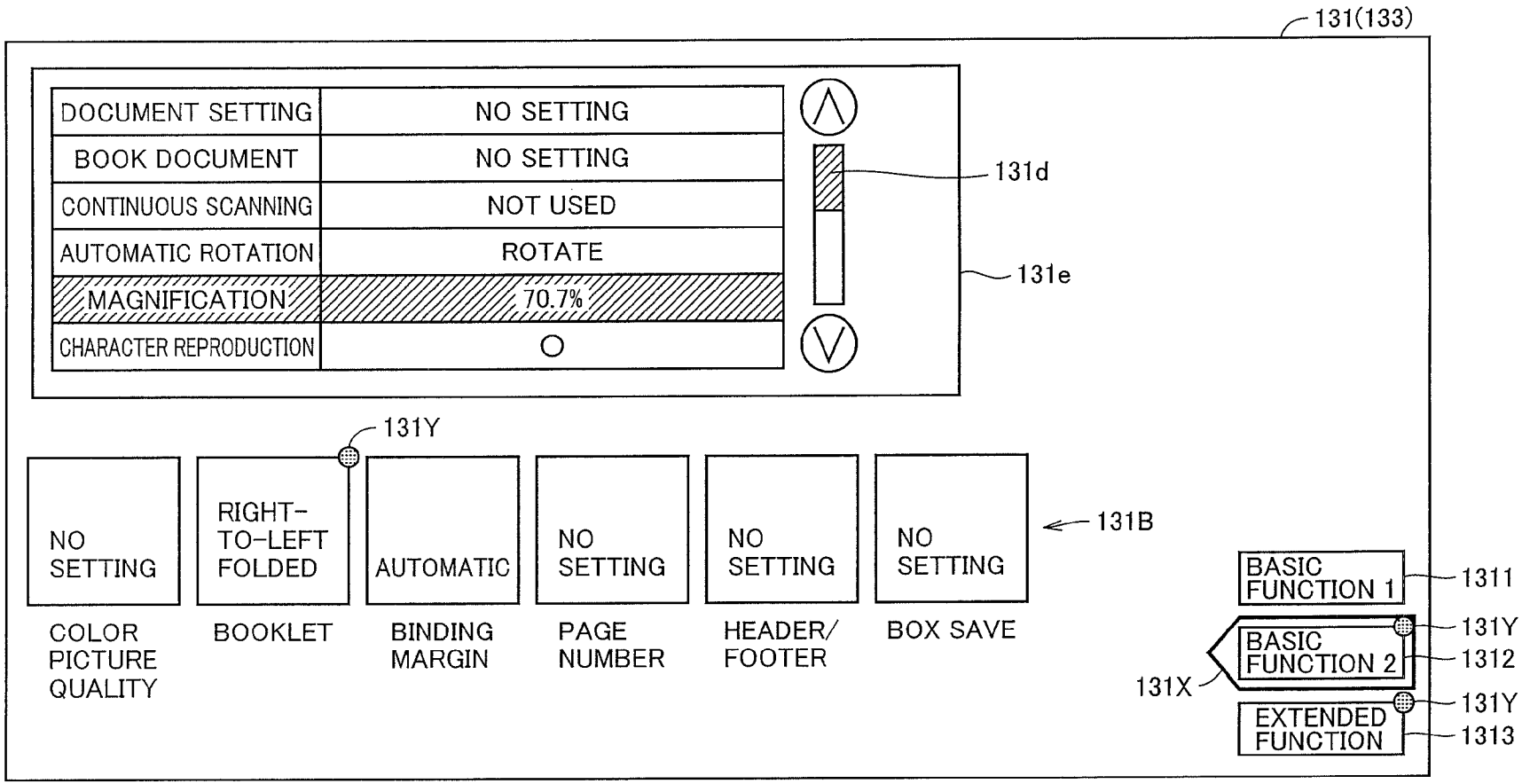
FIG. 18 is a pictorial representation of touch panel 133 when the "booklet" function belonging to a category "Basic Function 2" is set at "right-to-left folded" according to a fifth embodiment.

Referring to the pictorial representation of touch panel 133 in FIG. 18, CPU 110 refers to the function relation table to reset automatically the functions belonging to category "Extended Function", when the "booklet" function belonging to the "Basic Function 2" category is set at "right-to-left folded".

More specifically, when the "booklet" function belonging to the "Basic Function 2" category is set at "right-to-left folded" in the present embodiment, CPU 110 sets the "magnification" function in the "Extended Function" category to "70.7%", the "duplex side/page aggregation" function in the "Extended Function" category to "one side→duplex side", and the finishing" function in the "Extended Function" category to "saddle stitch".

In response to the change in the setting of the function in "Basic Function 2", CPU 110 determines whether the setting of a function corresponding to "Basic Function 1" or "Extended Function" has been changed automatically or not. When the setting of a function belonging to category "Extended Function", differing from "Basic Function 2", has been changed, the display manner of button 1313 of the relevant "Extended Function" is modified from the former display manner.

Similarly in the present embodiment, CPU 110 causes touch panel 133 to display mark 131Y on button 1313 indicating "Extended Function". CPU 110 also causes touch panel 133 to display mark 131Y on button 1312 indicating currently selected "Basic Function 2". In other words, CPU 110 modifies the display manner of a software button indicating the category to which the function whose setting has been changed by the user belongs to and the display manner of a software button indicating the category to which the function whose setting has been changed automatically by the relevant change belongs to, each from the former display manner.

Particularly, in the present embodiment, CPU 110 causes touch panel 133 to display, not only software button 131B indicating the function belonging to the currently selected category (first category), but also object 131*e* indicating the designation and setting contents corresponding to all the functions belonging to the category (second category) with the function whose setting has been changed automatically in a list. In the case where CPU 110 cannot display the designation and setting contents of all the functions belonging to the second category at one time, scroll bar 131*d* is displayed to allow the user to confirm the designation and setting contents of all the functions belonging to the second category.

Similarly in the present embodiment, CPU 110 may differentiate the display manner of the designation and setting contents of a function belonging to the second category and whose setting has been changed automatically from the display manner of the designation and setting contents of the function belonging to the second category and whose setting has not been changed automatically via touch panel 133.

Thus, the user can be notified that the setting of a function not belonging to the currently selected category has been modified automatically in the present embodiment. Particularly, the user can be notified of a category to which the function whose setting has been changed automatically belongs to and the relevant function.

Control Method

A control process at image formation apparatus 100 according to the present embodiment will be described hereinafter with reference to the flowchart of FIG. 19. In the following, it is assumed that "Basic Function 2" is selected as the category. In other words, it is assumed that CPU 110 provides the display of software buttons 131B indicating the functions corresponding to "Basic Function 2" on touch panel 133 in a selectable manner, as shown in FIG. 5.

Figure 19:
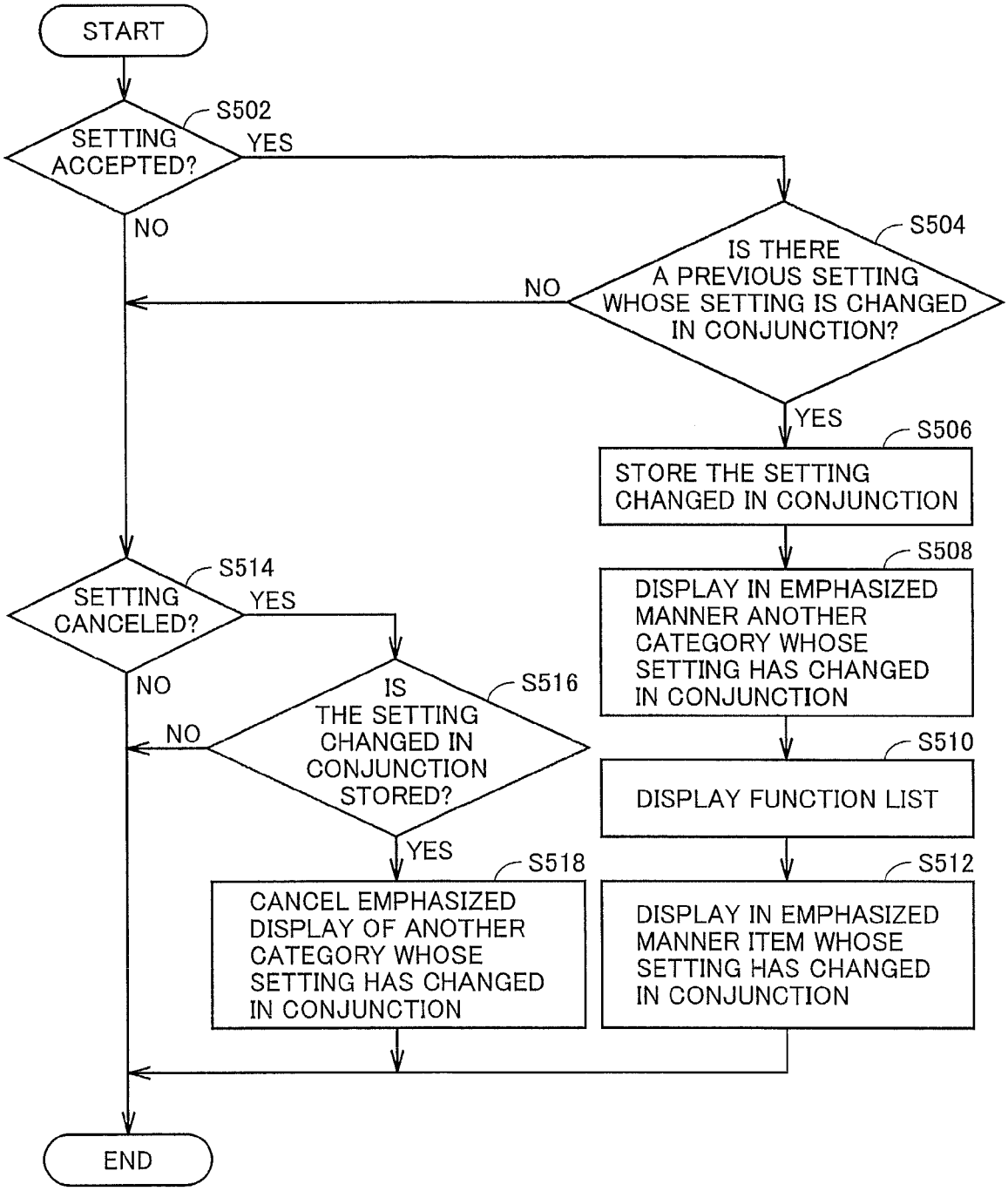
FIG. 19 is a flowchart of a control process at image formation apparatus 100 according to the fifth embodiment.

Referring to FIG. 19, CPU 110 determines whether a setting related to a function corresponding to "Basic Function 2" has been accepted from a user through touch panel 133 (step S502). When a setting related to the function corresponding to "Basic Function 2" is not accepted from the user (when NO at step S502), CPU 110 executes the process starting from step S514.

When a setting related to a function corresponding to "Basic Function 2" is accepted from the user (YES at step S502), CPU 110 refers to the function relation table to determine whether there is a function whose setting is automatically changed in conjunction with the relevant setting, among the functions corresponding to "Basic Function 1" or "Extended Function" (step S504). When there is no function whose setting is to be automatically changed in conjunction with the relevant setting among the functions corresponding to "Basic Function 1" or "Extended Function" (NO at step S504), CPU 110 executes the process starting from step S514.

When there is a function whose setting is to be changed automatically in conjunction with the relevant setting among the functions corresponding to "Basic Function 1" or "Extended Function" (YES at step S504), CPU 110 stores the setting changed automatically in conjunction with the relevant setting into RAM 103 (step S506).

Then, as shown in FIG. 18, CPU 110 causes touch panel 133 to display, in an emphasized manner, software button 1313 indicating the "Extended Function" category corresponding to the function whose setting was changed automatically in conjunction with the relevant setting (step S508). In other words, CPU 110 causes touch panel 133 to display object 131*e* indicating the designation and setting contents corresponding to the function belonging to the "Extended Function" category in a list (step S510). Then, CPU 110 provides the display of the designation and setting contents corresponding to the function whose setting has been changed automatically among the functions in the function list, in an emphasized manner (step S512). CPU 110 terminates the control process, i.e. repeats the process from step S502.

When a setting related to a function corresponding to "Basic Function 2" is not accepted from the user (NO at step S502), a determination is made whether the currently selected setting has been canceled by the user or not (step S514). When the currently selected setting is not canceled (NO at step S514), CPU 110 terminates the control process, i.e. repeats the process from step S502.

When the currently selected setting is canceled (YES at step S514), CPU 110 determines whether the setting changed in conjunction with the relevant setting is stored in RAM 103 at step S506 (step S516). When a setting changed in conjunction with the relevant setting is not stored in RAM 103 at step S506 (NO at step S16), the control process is terminated, i.e. the process starting from step S502 is repeated.

When a setting changed in conjunction with the relevant setting is stored in RAM 103 at step S506 (YES at step S116), CPU 110 terminates the emphasized display of software button 1311 indicating the "Extended Function" category corresponding to the function whose setting was changed automatically in conjunction with the relevant setting (step S518). In other words, CPU 110 returns the display of touch panel 133 from the state of FIG. 18 (mark displayed state) to the information indicated in FIG. 5 (no mark state) on touch panel 133. Then, CPU 110 terminates the control process, i.e. repeats the process from step S502.

CPU 110 may cause touch panel 133 to display a mark on software button 131B directly representing the function changed by the user. CPU 110 may cause touch panel 133 to display a mark on software button 1312 indicating the category that includes the function changed by the user.

Sixth Embodiment

A sixth embodiment of the present invention will be described hereinafter. Image formation apparatus 100 of the second to fifth embodiments set forth above is directed to changing the display manner of a software button 1311 (1313) indicating the second category from the former display manner when the setting of a function of a category (second category) other than the first category is modified automatically in the case where the setting of the function belonging to the currently selected category (first category) is changed.

In contrast, image formation apparatus 100 of the sixth embodiment is directed to, when the setting of a function belonging to the currently selected category (first category) is canceled, changing the display manner of software button 1311 indicating the second category from the former display manner in the event of the setting of a function of a category (second category) other than the first category being changed automatically by the relevant cancellation.

Although the following description is based on the case where the technique according to the present embodiment is applied to the second embodiment, the technique of the present embodiment is commonly applicable to image formation apparatus 100 of the first and third to fifth embodiments set forth above.

The description of the configuration of image formation apparatus 100 of the present embodiment that is similar to the configuration of image formation apparatus 100 of the first embodiment will not be repeated. For example, the overall configuration of image formation apparatus 100, the configuration of the print engine portion of image formation apparatus 100, and the hardware configuration of image formation apparatus 100 of the present embodiment are similar to those of the first embodiment shown in FIGS. 1-3. Furthermore, the process to terminate the display of an object indicating a function whose setting has been changed automatically (for example, software button 131*ab* or the like) is similar to that of the second embodiment, as shown in FIGS. 10-13. Therefore, description thereof will not be repeated.

Schematic Operation Related to User Interface

A schematic operation related to a user interface according to the sixth embodiment will be described hereinafter. In the present embodiment, CPU 110 implements a user interface set forth below utilizing touch panel 133.

Similarly in the present embodiment, a function relation table representing the relationship between a plurality of functions is stored in RAM 103. For example, when the setting of any of the functions corresponding to "Basic Function 2" is changed, there is the case where CPU 110 automatically changes the setting of a function corresponding to "Basic Function 1" or "Extended Function". The following description is based on the case where the "booklet" function belonging to the "Basic Function 2" category is set to "right-to-left folded".

Referring to the pictorial representation of touch panel 133 in FIG. 8, CPU 110 refers to the function relation table to reset automatically the functions belonging to category "Basic Function 1", when the "booklet" function belonging to category "Basic Function 2" is set at "right-to-left folded". Similarly, when the setting of "booklet" function belonging to category "Basic Function 2" is cancelled, CPU 110 refers to the function relation table to automatically return the setting of the functions belonging to category "Basic Function 1" to the former setting.

More specifically, when the "booklet" function belonging to the "Basic Function 2" category is set at "right-to-left folded", CPU 110 sets the "magnification" function belonging to the "Basic Function 1" category to "70.7%", the "duplex side/page aggregation" function belonging to the "Basic Function 1" category to "one side→duplex side", and the "finishing" function belonging to the "Basic Function 1" category to "saddle stitch". Then, when the "booklet" function belonging to the "Basic Function 2" category is canceled, CPU 110 returns the "magnification" function belonging to the "Basic Function 1" category to "100%", the "duplex side/page aggregation" function belonging to the "Basic Function 1" category to "one side→one side", and the "finishing" function belonging to the "Basic Function 1" category to "none".

In response to the change in the setting of the function in "Basic Function 2", CPU 110 determines whether the setting of a function corresponding to "Basic Function 1" or "Extended Function" has been changed automatically or not. When the setting of a function belonging to the "Basic Function 1" category, differing from "Basic Function 2", has been changed, the display manner of button 1311 of the relevant "Basic Function 1" is modified from the former display manner. Furthermore, CPU 110 determines whether the setting of a function corresponding to "Basic Function 1" or "Extended Function" has been changed automatically or not in response to the cancellation of the setting of a function belonging to the "Basic Function 2" category. When the setting of a function belonging to the "Basic Function 1" category, differing from the "Basic Function 2" category, has been changed, the display manner of button 1311 of the relevant "Basic Function 1" is modified from the former display manner.

Similarly in the present embodiment, CPU 110 causes the display of mark 131Y on button 1311 indicating "Basic Function 1" on touch panel 133. CPU 110 also causes the display of mark 131Y on button 1312 indicating currently selected "Basic Function 2". In other words, CPU 110 modifies the display manner of a software button indicating the category to which the function whose setting has been changed and canceled by the user belongs to from the display manner of a software button indicating the category to which the function whose setting has been changed automatically and canceled by the relevant change belongs to, each from the former display manner.

Particularly, in the present embodiment, CPU 110 causes touch panel 133 to display, not only software button 131B indicating the function belonging to the currently selected category, but also software button 131*a* whose setting has been changed and canceled automatically.

Thus, the present embodiment allows the user to be notified that the setting of a function not belonging to the currently selected category has been changed and canceled automatically. Particularly, the user can be notified of the category to which the function whose setting has been changed and canceled automatically belongs to in the present embodiment.

Control Method

A control process at image formation apparatus 100 of the present embodiment will be described hereinafter with reference to the flowchart of FIG. 20. In the following, it is assumed that "Basic Function 2" is selected. In other words, it is assumed that CPU 110 provides the display of software buttons 131B indicating the functions corresponding to "Basic Function 2" on touch panel 133 in a selectable manner.

Figure 20:
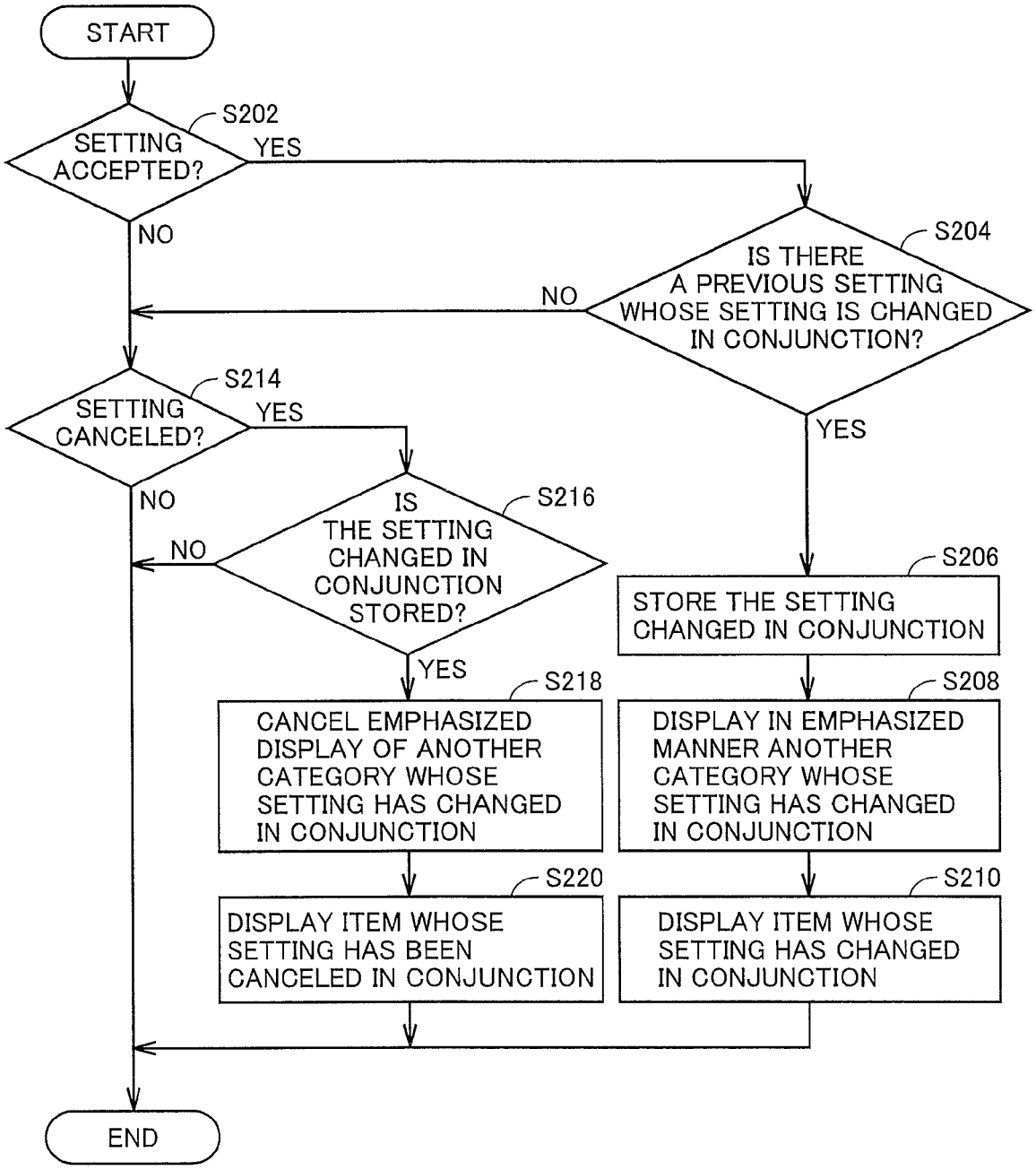
FIG. 20 is a flowchart of a control process at image formation apparatus 100 according to a sixth embodiment.

Referring to FIG. 20, CPU 110 determines whether a setting related to a function corresponding to "Basic Function 2" has been accepted from the user through touch panel 133 (step S202). When a setting related to a function corresponding to "Basic Function 2" is not accepted from the user (NO at step S202), CPU 110 executes the process starting from step S214.

When a setting related to a function corresponding to "Basic Function 2" is accepted from the user (YES at step S202), CPU 110 refers to the function relation table to determine whether there is a function whose setting is changed automatically in conjunction with the relevant setting, among the functions corresponding to "Basic Function 1" or "Extended Function" (step S204). When there is no function whose setting will be automatically changed in conjunction with the relevant setting among the functions corresponding to "Basic Function 1" or "Extended Function" (NO at step S204), CPU 110 executes the process starting from step S214.

When there is a function whose setting is to be changed automatically in conjunction with the relevant setting among the functions corresponding to "Basic Function 1" or "Extended Function" (YES at step S204), CPU 110 stores the setting changed automatically in conjunction with the relevant setting in RAM 103 (step S206).

Then, as shown in FIG. 8, CPU 110 causes touch panel 133 to display, in an emphasized manner, software button 1311 indicating the "Basic Function 1" category corresponding to the function whose setting was changed automatically in conjunction with the relevant setting (step S208). CPU 110 causes touch panel 133 to display, in an emphasized manner, the function whose setting has been changed automatically as software button 131*a* (step S210). CPU 110 ends the control process, i.e. repeats the process starting from step S202.

When a setting related to a function corresponding to "Basic Function 2" is not accepted from the user (NO at step S202), CPU 110 determines whether the currently selected setting has been canceled by the user (step S214). When the currently selected setting is not canceled (NO at step S214), CPU 110 terminates the control process, i.e. repeats the process starting from step S202.

When the currently selected setting is canceled (YES at step S214), CPU 110 determines whether the setting changed in conjunction with the relevant setting is stored in RAM 103 at step S206 (step S216). When a setting changed in conjunction with the relevant setting is not stored in RAM 103 at step S206 (NO at step 216), the control process is terminated, i.e. the process starting from step S202 is repeated.

When a setting changed automatically in conjunction with the relevant setting is stored in RAM 103 at step S206 (YES at step S216), CPU 110 cancels the setting of the function whose setting was changed automatically and terminates the emphasized display of software button 1311 indicating the "Basic Function 1" category corresponding to the function whose setting was changed automatically (step S218). CPU 110 causes touch panel 133 to display, in an emphasized manner, the function whose setting was changed automatically as software button 131*a* (step S220). Then, CPU 110 terminates the control process, i.e. repeats the process from step S202.

Other Embodiments

It is to be noted that the present invention is applicable even in the case where the present invention is achieved by supplying a program to an image formation apparatus. The advantage of the present invention can be obtained by supplying a recording medium storing a program represented by software directed to achieving the present invention to a system or an apparatus, and causing a computer (or CPU or MPU) of that system or apparatus to read out and execute program codes stored in the storage medium.

In this case, the program code per se read out from the storage medium will implement the functions of the embodiments described above, and the storage medium storing the program codes will constitute the present invention.

Furthermore, the present invention corresponds to the case where the functions of the embodiments set forth above are realized, not only by executing program codes read out by the computer, but also by a process according to an operating system (OS) running on the computer performing a part of or all of the actual process, based on the commands of the relevant program codes.

In addition, the present invention corresponds to the case where the program codes read out from the storage medium may be written to a memory included in a functionality expansion board inserted to a computer or a functionality expansion unit connected to the computer. The functions of the embodiments described above may be realized by a process according to a CPU or the like provided on the functionality expansion board or the functionality expansion unit, performing a part of or all of the actual process, based on the commands of the relevant program codes.

Examples of the storage media include media storing a program in a non-volatile manner, such as a CD-ROM (Compact Disc-Read Only Memory), a DVD-ROM (Digital Versatile Disk-Read Only Memory), a USB (Universal Serial Bus) memory, a memory card, an FD (Flexible Disk), a hard disk, a magnetic tape, a cassette tape, an MO (Magnetic Optical Disc), an MD (Mini Disc), an IC (Integrated Circuit) card (excluding memory cards), an optical card, a mask ROM, an EPROM, an EEPROM (Electronically Erasable Programmable Read-Only Memory), and the like.

Thus, the present embodiment allows the user to be notified that, when the user enters a setting related to a first function belonging to a first category, the setting related to a second function belonging to a second category has been changed automatically in conjunction with the relevant setting.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image formation apparatus including a plurality of categories, wherein each category includes a plurality of functions, said image formation apparatus comprising:

a display, a first display controller configured to cause said display to display user-selectable category objects respectively indicating said plurality of categories, a first acceptance unit configured to receive a selection of a first category object indicating a first category among said plurality of categories, a second display controller configured to cause said display to display a screen comprising a plurality of user-selectable first function objects used for performing a setting related to a plurality of first functions, respectively, which are included in said first category indicated by the selected first category object, a second acceptance unit configured to receive a user selection of a first function object to perform a setting related to a first function indicated by said first function object, among said plurality of displayed first function objects, a determination unit configured to determine whether a setting of a second function included in a second category, other than said first category, is to be changed or not based on a setting entered for said first function, and a display modification unit configured to cause said display, in response to a determination by the determination unit that said setting of the second function included in the second category has been changed, to display, on said screen, a user-selectable second function object used for performing a setting related to the second function whose setting has been changed, together with said plurality of first function objects included in the first category, wherein said plurality of the first function objects displayed by the display modification unit include a function object corresponding to a first function whose setting is not changed.

2. The image formation apparatus according to claim 1, wherein said display modification unit modifies, when the setting of said second function has changed, a display manner of the category object of said second category.

3. The image formation apparatus according to claim 1, wherein a display manner of said second function object differs from the display manner of said first function object.

4. The image formation apparatus according to claim 1, wherein said display modification unit terminates display of said second function object when any of software buttons appearing on said display is depressed.

5. The image formation apparatus according to claim 4, wherein a condition to terminate display of said second function object differs depending upon a type of said second category.

6. The image formation apparatus according to claim 1, further comprising a hardware button, wherein said display modification unit terminates display of said second function object when said hardware button is depressed.

7. The image formation apparatus according to claim 1, wherein said display modification unit terminates display of said second function object when a category other than said second category is selected.

8. The image formation apparatus according to claim 1, further comprising a timer to count a time during which said second function object is displayed, wherein said display modification unit terminates display of said second function object when the time during which said second function object is displayed reaches a predetermined value.

9. The image formation apparatus according to claim 1, wherein said display modification unit causes said display, when said setting of said second function has changed, to display a list of designations of functions corresponding to said second category as a second function object.

10. The image formation apparatus according to claim 1, wherein the display modification unit is configured to cause said display to display the second function object in a selectable manner for accepting a setting related to said second function.

11. The image formation apparatus according to claim 1, wherein said second display controller is configured to cause said display to display a plurality of buttons as said plurality of first function objects, in a selectable manner, wherein each of said plurality of buttons is used for performing a setting related to respective ones of said plurality of first functions, and wherein said display modification unit is configured to cause said display to display said second function object indicating said second function whose setting is changed, together with said plurality of buttons.

12. A display method for an image formation apparatus including a plurality of categories, wherein each category includes a plurality of functions, said image formation apparatus including a display, said display method comprising the steps of:

causing said display to display user-selectable category objects indicating said plurality of categories, respectively, accepting a selection of a first category among said plurality of categories, causing said display to display a screen comprising a plurality of user-selectable first function objects used for performing a setting related to a plurality of first functions, respectively, which are included in said selected first category, accepting a user selection of a first function object, among said plurality of displayed first function objects, to perform a setting related to the first function, determining, by a determination unit of the image formation apparatus, whether a setting of a second function included in a second category, other than said first category, is to be changed or not based on a setting entered for said first function, and causing said display, in response to determining by the determination unit that the setting of the second function included in said second category has been changed, to display, on said screen, a user-selectable second function object used for performing a setting related to the second function whose setting has been changed, together with said plurality of first function objects included in the first category, wherein said plurality of the first function objects displayed by the display include a function object corresponding to a first function whose setting is not changed.

13. The display method for an image formation apparatus according to claim 12 further comprising:

causing said display to display a plurality of buttons as said plurality of first function objects, in a selectable manner, wherein each of said plurality of buttons is used for performing a setting related to a respective one of said plurality of first functions, and causing the display to display said second function object indicating said second function whose setting is changed, together with said plurality of buttons.

14. A non-transitory computer readable recording medium storing a display program for an image formation apparatus including a plurality of categories, wherein each category includes a plurality of functions, said image formation apparatus including a display and a processor, said display program causing said processor to execute the steps of:

causing said display to display user-selectable category objects indicating said plurality of categories, respectively, accepting a selection of a first category among said plurality of categories, causing said display to display a screen comprising a plurality of user-selectable first function objects used for performing a setting related to a plurality of first functions, respectively, which are included in said selected first category, accepting a user selection of a first function object, among said plurality of displayed first function objects, to perform a setting related to the first function, determining whether a setting of a second function included in a second category, other than said first category, is to be changed or not based on a setting entered for said first function, and causing said display, in response to a determination that the setting of the second function included in said second category has been changed, to display, on said screen, a user-selectable second function object used for performing a setting related to the second function whose setting has been changed, together with said plurality of first function objects included in the first category, wherein said plurality of the first function objects displayed by the display include a function object corresponding to a first function whose setting is not changed.

15. The non-transitory computer readable recording medium according to claim 14, wherein said display program causes said processor to execute further steps of:

causing said display to display a plurality of buttons as said plurality of first function objects, in a selectable manner, wherein each of said plurality of buttons is used for performing a setting related to a respective one of said plurality of first functions, and causing the display to display said second function object indicating said second function whose setting is changed, together with said plurality of buttons.

16. An image formation apparatus including a plurality of functions, each associated with any of a plurality of categories, said image formation apparatus comprising:

a display, a first display controller configured to cause said display to display category objects respectively indicating said plurality of categories, in a selectable manner, a first acceptance unit configured to receive a selection of a first category object indicating a first category among said plurality of categories, a second display controller configured to cause said display to display, in a selectable manner, a first function object indicating a first function, among said plurality of functions, corresponding to said selected first category, a second acceptance unit configured to receive a selection of said first function object to perform a setting related to the first function, a determination unit configured to determine whether a setting of a second function corresponding to a second category, other than said first category, is to be changed or not based on a setting entered for said first function, and a display modification unit configured to cause said display, when said setting of the second function corresponding to the second category has been determined to be changed, to display:

said first function object indicating functions, respectively, corresponding to said first category;

a second function object indicating said second function whose setting has changed, belonging to said second category, together with said first function object; and a third function object indicating a function other than said second function whose setting has changed in said second category, wherein a display manner of said second function object differs from the display manner of said third function object.

17. The image formation apparatus according to claim 16, wherein said first function object includes a software button of a first size, each of said second and third function objects includes a software button of a second size that is smaller than said first size.

18. The image formation apparatus according to claim 16, wherein said first function object includes a software button of a first size, each of said second and third function objects includes a mark smaller than said first size, and a mark corresponding to said second and third function objects constitutes a function bar.

19. A display method for an image formation apparatus including a plurality of categories, wherein each category includes a plurality of functions, said image formation apparatus including a display, said display method comprising the steps of:

causing said display to display category objects respectively indicating said plurality of categories, in a selectable manner, accepting a selection of a first category among said plurality of categories, causing said display to display, in a selectable manner, a first function object indicating a first function, among said plurality of functions, corresponding to said selected first category, receiving a selection of a first function object to perform a setting related to the first function, determining whether a setting of a second function corresponding to a second category, other than said first category, is to be changed or not based on a setting entered for said first function, and causing said display, when said setting of the second function corresponding to the second category has been determined to be changed, to display:

said first function object indicating functions, respectively, corresponding to said first category;

a second function object indicating said second function whose setting has changed, belonging to said second category, together with said first function object; and a third function object indicating a function other than said second function whose setting has changed in said second category, wherein a display manner of said second function object differs from the display manner of said third function object.

20. The method according to claim 19, wherein said first function object includes a software button of a first size, each of said second and third function objects includes a software button of a second size that is smaller than said first size.

21. The method according to claim 19, wherein said first function object includes a software button of a first size, each of said second and third function objects includes a mark smaller than said first size, and a mark corresponding to said second and third function objects constitutes a function bar.

22. A non-transitory computer readable recording medium storing a display program for an image formation apparatus including a plurality of categories, wherein each category includes a plurality of functions, said image formation apparatus including a display and a processor, said display program causing said processor to execute the steps of:

causing said display to display category objects respectively indicating said plurality of categories, in a selectable manner, accepting a selection of a first category among said plurality of categories, causing said display to display, in a selectable manner, a first function object indicating a first function, among said plurality of functions, corresponding to said selected first category, receiving a selection of a first function object to perform a setting related to the first function, determining whether a setting of a second function corresponding to a second category, other than said first category, is to be changed or not based on a setting entered for said first function, and causing said display, when said setting of the second function corresponding to the second category has been determined to be changed, to display:

said first function object indicating functions, respectively, corresponding to said first category;

a second function object indicating said second function whose setting has changed, belonging to said second category, together with said first function object; and a third function object indicating a function other than said second function whose setting has changed in said second category, wherein a display manner of said second function object differs from the display manner of said third function object.

23. The non-transitory computer readable recording medium storing a display program according to claim 22, wherein said first function object includes a software button of a first size, each of said second and third function objects includes a software button of a second size that is smaller than said first size.

24. The non-transitory computer readable recording medium storing a display program according to claim 22, wherein said first function object includes a software button of a first size, each of said second and third function objects includes a mark smaller than said first size, and a mark corresponding to said second and third function objects constitutes a function bar.

* * * * *